US007604523B1

(12) United States Patent
Wedding et al.

(10) Patent No.: US 7,604,523 B1
(45) Date of Patent: Oct. 20, 2009

(54) PLASMA-SHELL PDP

(75) Inventors: Carol Ann Wedding, Toledo, OH (US); Daniel Keith Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 348 days.

(21) Appl. No.: 11/149,318

(22) Filed: Jun. 10, 2005

Related U.S. Application Data

(60) Provisional application No. 60/580,715, filed on Jun. 21, 2004.

(51) Int. Cl.
*H01J 9/00* (2006.01)
*H01J 17/49* (2006.01)

(52) U.S. Cl. ..... 445/23; 313/582

(58) Field of Classification Search ..... 313/582–587, 313/483

See application file for complete search history.

(56) References Cited

U.S. PATENT DOCUMENTS

| | | | |
|---|---|---|---|
| 2,187,432 | A | 1/1940 | Powers |
| 2,644,113 | A | 6/1953 | Etzkorn |
| 3,050,654 | A | 8/1962 | Toulon |
| 3,264,073 | A | 8/1966 | Schmitt et al. |
| 3,365,315 | A | 1/1968 | Beck et al. |
| 3,602,754 | A | 8/1971 | Pfaender et al. |
| 3,607,169 | A | 9/1971 | Cox |
| 3,646,384 | A | 2/1972 | Lay |
| 3,652,891 | A | 3/1972 | Janning |
| 3,654,680 | A | 4/1972 | Bode et al. |
| 3,666,981 | A | 5/1972 | Lay |
| 3,674,461 | A | 7/1972 | Farnand et al. |
| 3,699,050 | A | 10/1972 | Henderson |
| 3,793,041 | A | 2/1974 | Snowman |
| 3,811,061 | A | 5/1974 | Nakayama et al. |
| 3,838,998 | A | 10/1974 | Matthews et al. |
| 3,848,248 | A | 11/1974 | MacIntyre |
| 3,860,846 | A | 1/1975 | Mayer |
| 3,885,195 | A | 5/1975 | Amano |
| 3,916,584 | A | 11/1975 | Howard et al. |
| 3,927,342 | A | 12/1975 | Bode et al. |
| 3,935,494 | A | 1/1976 | Dick et al. |
| 3,964,050 | A | 6/1976 | Mayer |
| 3,969,718 | A | 7/1976 | Strom |
| 3,975,194 | A | 8/1976 | Farnand et al. |
| 3,990,068 | A | 11/1976 | Mayer et al. |
| 3,998,618 | A | 12/1976 | Kreick et al. |
| 4,027,188 | A | 5/1977 | Bergman |
| 4,035,690 | A | 7/1977 | Roeber |
| 4,038,577 | A | 7/1977 | Bode et al. |
| 4,075,025 | A | 2/1978 | Rostoker |
| 4,106,009 | A | 8/1978 | Dick |
| 4,119,422 | A | 10/1978 | Rostoker |
| 4,126,807 | A | 11/1978 | Wedding et al. |
| 4,126,809 | A | 11/1978 | Wedding et al. |
| 4,133,854 | A | 1/1979 | Hendricks |
| 4,163,637 | A | 8/1979 | Hendricks |
| 4,164,678 | A | 8/1979 | Biazzo et al. |
| 4,166,147 | A | 8/1979 | Lange et al. |
| 4,257,798 | A | 3/1981 | Hendricks et al. |
| 4,279,632 | A | 7/1981 | Frosch et al. |

(Continued)

*Primary Examiner*—Joseph L Williams
(74) *Attorney, Agent, or Firm*—Donald K Wedding

(57) ABSTRACT

Plasma-shells filled with ionizable gas are positioned on or within a rigid or flexible substrate. Each Plasma-shell is electrically connected to at least two electrical conductors such as electrodes with an electrically conductive bonding substance to form an electrical connection to each electrode. The electrically conductive bonding substance may comprise a pad connected to both the Plasma-shell and an electrode.

26 Claims, 18 Drawing Sheets

Top View

U.S. PATENT DOCUMENTS 4,290,847 A 9/1981 Johnson et al.
4,303,061 A 12/1981 Torobin
4,303,431 A 12/1981 Torobin
4,303,432 A 12/1981 Torobin
4,303,433 A 12/1981 Torobin
4,303,603 A 12/1981 Torobin
4,303,729 A 12/1981 Torobin
4,303,730 A 12/1981 Torobin
4,303,731 A 12/1981 Torobin
4,303,732 A 12/1981 Torobin
4,303,736 A 12/1981 Torobin
4,307,051 A 12/1981 Sargeant et al.
4,314,827 A 2/1982 Leitheiser et al.
4,322,378 A 3/1982 Hendricks
4,344,787 A 8/1982 Beggs et al.
4,349,456 A 9/1982 Sowman
4,363,646 A 12/1982 Torobin
4,391,646 A 7/1983 Howell
4,392,988 A 7/1983 Dobson et al.
4,415,512 A 11/1983 Torobin
4,459,145 A 7/1984 Elsholz
4,494,038 A 1/1985 Wedding et al.
4,525,314 A 6/1985 Torobin
4,542,066 A 9/1985 Delzant
4,547,233 A 10/1985 Delzant
4,548,196 A 10/1985 Torobin
4,548,767 A 10/1985 Hendricks
4,568,389 A 2/1986 Torobin
4,582,534 A 4/1986 Torobin
4,596,681 A 6/1986 Grossman et al.
4,618,525 A 10/1986 Chamberlain et al.
4,637,990 A 1/1987 Torobin
4,638,218 A 1/1987 Shinoda et al.
4,671,909 A 6/1987 Torobin
4,713,300 A 12/1987 Sowman et al.
4,737,687 A 4/1988 Shinoda et al.
4,743,511 A 5/1988 Sowman et al.
4,743,545 A 5/1988 Torobin
4,757,036 A 7/1988 Kaar et al.
4,777,154 A 10/1988 Torobin
4,778,502 A 10/1988 Garnier et al.
4,793,980 A 12/1988 Torobin
4,797,378 A 1/1989 Sowman
4,800,180 A 1/1989 McAllister et al.
4,865,875 A 9/1989 Kellerman
4,879,321 A 11/1989 Laroche
4,883,779 A 11/1989 McAllister et al.
4,963,792 A 10/1990 Parker
5,017,316 A 5/1991 Sowman
5,053,436 A 10/1991 Delgado
5,069,702 A 12/1991 Block et al.
5,077,241 A 12/1991 Moh et al.
5,185,299 A 2/1993 Wood et al.
5,212,143 A 5/1993 Torobin
5,225,123 A 7/1993 Torobin
5,326,298 A 7/1994 Hotomi
5,397,759 A 3/1995 Torobin
5,793,158 A 8/1998 Wedding
5,984,747 A 11/1999 Bhagavatula et al.
6,255,777 B1 7/2001 Kim et al.
6,368,708 B1 4/2002 Brown et al.
6,545,422 B1 4/2003 George et al.
6,570,335 B1 5/2003 George et al.
6,612,889 B1 9/2003 Green et al.
6,620,012 B1 9/2003 Johnson et al.
6,633,117 B2 10/2003 Shinoda et al.
6,646,388 B2 11/2003 George et al.
6,650,055 B2 11/2003 Ishimoto et al.
6,677,704 B2 1/2004 Ishimoto et al.
6,762,566 B1 7/2004 George et al.
6,764,367 B2 7/2004 Green et al.
6,791,264 B2 9/2004 Green et al.
6,794,812 B2 9/2004 Yamada et al.
6,796,867 B2 9/2004 George et al.
6,801,001 B2 10/2004 Drobot et al.
6,822,626 B2 11/2004 George et al.
6,836,063 B2 12/2004 Ishimoto et al.
6,836,064 B2 12/2004 Yamada et al.
6,841,929 B2 1/2005 Ishimoto et al.
6,857,923 B2 2/2005 Yamada et al.
6,864,631 B1 3/2005 Wedding
6,893,677 B2 5/2005 Yamada et al.
6,902,456 B2 6/2005 George et al.
6,914,382 B2 7/2005 Ishimoto et al.
6,930,442 B2 8/2005 Awamoto et al.
6,932,664 B2 8/2005 Yamada et al.
6,935,913 B2 8/2005 Wyeth et al.
6,969,292 B2 11/2005 Tokai et al.
6,975,068 B2 12/2005 Green et al.
7,005,793 B2 2/2006 George et al.
7,025,648 B2 4/2006 Green et al.
7,049,748 B2 5/2006 Tokai et al.
7,083,681 B2 8/2006 Yamada et al.
7,122,961 B1 * 10/2006 Wedding ..... 313/582
7,125,305 B2 10/2006 Green et al.
7,137,857 B2 11/2006 George et al.
7,140,941 B2 11/2006 Green et al.
7,157,854 B1 1/2007 Wedding
7,176,628 B1 2/2007 Wedding
7,247,989 B1 7/2007 Wedding
7,307,602 B1 12/2007 Wedding et al.
2001/0028216 A1 10/2001 Tokai et al.
2003/0182967 A1 10/2003 Tokai et al.
2004/0033319 A1 2/2004 Yamada et al.
2004/0063373 A1 4/2004 Johnson et al.
2005/0095944 A1 5/2005 George et al.
2006/0097620 A1 5/2006 George et al.
2007/0015431 A1 1/2007 Green et al.

* cited by examiner

Top View

Section View A-A

Top View
Without the Plasma-sphere

Top View

Section View A-A

Top View
Without the Plasma-sphere

Top View

Section View A-A

Top View
Without the Plasma-disc

Top View

Section View A-A

Top View
Without the Plasma-disc

Top View

Section View A-A

Top View
Without the Plasma-disc

Top View

Section View A-A

Top View
Without the Plasma-sphere

Top View

Section View A-A

Top View
Without the Plasma-disc

Top View

Section View A-A

Section View B-B

Top View
Without the Plasma-disc

Top View

Section View A-A

Top View
Without the Plasma-sphere

Top View

Section View A-A

Top View
Without the Plasma-dome

Top View

Section View A-A

Top View
Without the Plasma-dome

Top View

Section View A-A

Section View B-B

Top View
Without the Plasma-disc

Top View

Section View A-A

Top View
Without the Plasma-disc

Section A-A View

Section B-B View

PLASMA-SHELL PDP

RELATED APPLICATION

Priority is claimed under 35 U.S.C. 119(e) for Provisional Patent Application Ser. No. 60/580,715, filed Jun. 21, 2004.

FIELD OF THE INVENTION

This invention relates to the selective placement of one or more Plasma-shells in a plasma panel display (PDP). The PDP comprises one or more Plasma-shells on or within a rigid or flexible substrate with each Plasma-shell being electrically connected to at least two electrical conductors such as electrodes. An electrically conductive bonding substance is applied to each Plasma-shell to form an electrical connection to each electrode. A clearance space is provided to prevent the flow and wicking of the electrically conductive bonding substance from one connection to another. Each hollow Plasma-shell is filled with an ionizable gas and used as a pixel or subpixel in a gas discharge PDP device. A luminescent material such as phosphor may be located near, on, or in the Plasma-shell. This invention is particularly suitable for single substrate structures and/or for flexible or bendable displays. As used herein, Plasma-shell includes Plasma-disc, Plasma-dome, and Plasma-sphere. Combinations of Plasma-shells with different sizes and shapes may be used. Plasma-shells may be used alone or in combination with Plasma-tubes. In one embodiment each Plasma-shell and/or Plasma tube is positioned within an opening in the substrate such as a hole, cavity, well or the like that extends partially or completely though the substrate with the clearance space being part of or and extension of the opening. The clearance space may be of any suitable configuration such as a slot or channel.

BACKGROUND OF THE INVENTION

PDP Structures and Operation

This invention relates to a gas discharge plasma panel (PDP) comprising one or more addressable picture elements (pixels). In a gas discharge plasma display panel, each addressable picture element is a cell, sometimes referred to as a pixel. In a multicolor PDP, two or more cells or pixels may be addressed as sub-cells or sub-pixels to form a single cell or pixel. As used herein cell or pixel means sub-cell or sub-pixel. The cell or pixel element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

In the operation of a PDP, different voltage pulses are applied across a plasma display cell gap. These pulses include a write pulse, which is the voltage potential sufficient to ionize and discharge the gas at the pixel site. A write pulse is selectively applied across selected cell sites to cause a gas discharge at a selected cell. The gas discharge will produce visible light, UV light and/or IR light which may be used to excite a phosphor. Sustain pulses are a series of pulses that produce a voltage potential across pixels to maintain gas discharge of cells previously addressed with a write pulse. An erase pulse is used to selectively extinguish cells that are in the "on" state.

The voltage at which a pixel will discharge, sustain, and erase depends on a number of factors including the distance between the electrodes, the composition of the ionizing gas, and the pressure of the ionizing gas. Also of importance is the dielectric composition and thickness. To maintain uniform electrical and optical characteristics throughout the display it is desired that the various physical parameters adhere to required tolerances. Maintaining the required tolerance depends on cell geometry, fabrication methods and the materials used. The prior art discloses a variety of plasma display structures, a variety of methods of construction, and a variety of materials.

The practice of this invention includes monochrome (single color) AC plasma displays and multi-color (two or more colors) AC plasma displays. Also monochrome and multicolor DC plasma displays are contemplated.

Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are well known in the prior art and include those disclosed in U.S. Pat. Nos. 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber) and 5,793,158 (Wedding), all incorporated herein by reference.

This invention may be practiced in a DC gas discharge (plasma) display which is well known in the prior art, for example as disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention will be described with reference to an AC plasma display. The PDP industry has used two different AC plasma display panel (PDP) structures, the two-electrode columnar discharge structure, and the three-electrode surface discharge structure. Columnar discharge is also called co-planar discharge.

Columnar PDP

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding ('158), each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 (Shinoda et al.) and 5,674,553 (Shinoda et al.), 5,745,086 (Weber), and 5,736,815 (Amemiya), all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

RELATED PRIOR ART

Spheres, Beads, Ampoules, Capsules

The construction of a PDP out of gas filled hollow microspheres is known in the prior art. Such microspheres are referred to as spheres, beads, ampoules, capsules, bubbles, shells, and so forth. The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultra violet light onto a phosphor external to the ampoule itself.

U.S. Pat. No. 3,848,248 (MacIntyre) discloses the embedding of gas filled beads in a transparent dielectric. The beads are filled with a gas using a capillary. The external shell of the beads may contain phosphor.

U.S. Pat. No. 3,998,618 (Kreick et al.) discloses the manufacture of gas-filled beads by the cutting of tubing. The tubing is cut into ampoules (shown as domes in FIG. 2) and heated to form shells. The gas is a rare gas mixture, 95% neon and 5% argon at a pressure of 300 Torr.

U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture which emits a color upon discharge and/or by using a glass shell made from colored glass.

U.S. Pat. No. 4,963,792 (Parker) discloses a gas discharge chamber including a transparent dome portion.

U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen.

Japanese Patent 11238469A, published Aug. 31, 1999, by Tsuruoka Yoshiaki of Dainippon discloses a plasma display panel containing a gas capsule. The gas capsule is provided with a rupturable part which ruptures when it absorbs a laser beam.

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

The following U.S. patents issued to George et al. and the various joint inventors are incorporated herein by reference:

U.S. Pat. No. 6,570,335 (George et al.)
U.S. Pat. No. 6,612,889 (Green et al.)
U.S. Pat. No. 6,620,012 (Johnson et al.)
U.S. Pat. No. 6,646,388 (George et al.)
U.S. Pat. No. 6,762,566 (George et al.)
U.S. Pat. No. 6,764,367 (Green et al.)
U.S. Pat. No. 6,791,264 (Green et al.)
U.S. Pat. No. 6,796,867 (George et al.)
U.S. Pat. No. 6,801,001 (Drobot et al.)
U.S. Pat. No. 6,822,626 (George et al.)

Also incorporated herein by reference are the following U.S. Patent Application Publications filed by the various joint inventors of George et al.:

U.S. 2003/0164684 (Green et al.)
U.S. 2003/0207643 (Wyeth et al.)
U.S. 2004/0051450 (George et al.)

U.S. 2004/0063373 (Johnson et al.)
U.S. 2004/0106349 (Green et al.)
U.S. 2004/0166762 (Green et al.)

Methods of Producing Microspheres

Numerous methods and processes to produce hollow spheres or microspheres are well known in the prior art. Microspheres have been formed from glass, ceramic, metal, plastic and other inorganic and organic materials. Varying methods for producing spheres and microspheres have been disclosed and practiced in the prior art.

Some methods used to produce hollow glass microspheres incorporate a blowing gas into the lattice of a glass while in frit form. The frit is heated and glass bubbles are formed by the in-permeation of the blowing gas. Microspheres formed by this method have diameters ranging from about 5 μm to approximately 5,000 μm. This method produces spheres with a residual blowing gas enclosed in the sphere. The blowing gases typically include $SO_2$, $CO_2$, and $H_2O$. These residual gases will quench a plasma discharge. Because of these residual gases, microspheres produced with this method are not acceptable for producing Plasma-spheres for use in a PDP.

Methods of manufacturing glass frit for forming hollow microspheres are disclosed by U.S. Pat. Nos. 4,017,290 (Budrick et al.) and 4,021,253 (Budrick et al.), Budrick et al. ('290) discloses a process whereby occluded material gasifies to form the hollow microsphere.

Hollow microspheres are disclosed in U.S. Pat. No. 5,500,287 (Henderson), and U.S. Pat. No. 5,501,871 (Henderson). According to Henderson ('287), the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow sphere as described in step D in column 3 of Henderson ('287). Henderson ('287) and ('871) are limited to gases of small molecular size. Some gases such as xenon, argon, and krypton used in plasma displays may be too large to be permeated through the frit material or wall of the microsphere. Helium which has a small molecular size may leak through the microsphere wall or shell.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder which close and detach the elongated cylinder from the coaxial blowing nozzle. Surface tension forces acting on the detached cylinder form the latter into a spherical shape which is rapidly cooled and solidified by cooling means to form a glass microsphere.

In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference.

The microspheres may also be produced using a centrifuge apparatus and method as disclosed by U.S. Pat. No. 4,303,433 (Torobin) and WO8000695A1 (Torobin), both incorporated herein by reference.

Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference.

U.S. Pat. Nos. 3,607,169 (Coxe) and 4,303,732 (Torobin) disclose an extrusion method in which a gas is blown into molten glass and individual spheres are formed. As the spheres leave the chamber, they cool and some of the gas is trapped inside. Because the spheres cool and drop at the same time, the sphere shells do not form uniformly. It is also difficult to control the amount and composition of gas that remains in the sphere.

U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried and fired to convert them into microspheres. Prior to firing, the microcapsules are sufficiently porous that, if placed in a vacuum during the firing process, the gases can be removed and the resulting microspheres will generally be impermeable to ambient gases. The spheres formed with this method may be easily filled with a variety of gases and pressurized from near vacuums to above atmosphere. This is a suitable method for producing microspheres. However, shell uniformity may be difficult to control.

U.S. Patent Application Publication 2002/0004111 (Matsubara et al.), incorporated herein by reference, discloses a method of preparing hollow glass microspheres by adding a combustible liquid (kerosene) to a material containing a foaming agent.

Other methods for forming microspheres are disclosed in the prior art including U.S. Pat. Nos. 4,307,051 (Sargeant et al.), 4,775,598 (Jaeckel), and 4,917,857 (Jaeckel et al.), all of which are incorporated herein by reference.

Methods for forming microspheres are also disclosed in U.S. Pat. Nos. 3,848,248 (MacIntyre), 3,998,618 (Kreick et al.), and 4,035,690 (Roeber), discussed above and incorporated herein by reference.

Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference.

RELATED PRIOR ART

PDP Tubes

The following prior art references relate to the use of tubes in a PDP and are incorporated herein by reference.

U.S. Pat. No. 3,602,754 (Pfaender et al.) discloses a multiple discharge gas display panel in which filamentary or capillary size glass tubes are assembled to form a gas discharge panel.

U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel.

U.S. Pat. No. 3,969,718 (Strom) discloses a plasma display system utilizing tubes arranged in a side by side, parallel fashion.

U.S. Pat. No. 3,990,068 (Mayer et al.) discloses a capillary tube plasma display with a plurality of capillary tubes arranged parallel in a close pattern.

U.S. Pat. No. 4,027,188 (Bergman) discloses a tubular plasma display consisting of parallel glass capillary tubes sealed in a plenum and attached to a rigid substrate.

U.S. Pat. No. 5,984,747 (Bhagavatula et al.) discloses rib structures for containing plasma in electronic displays are formed by drawing glass preforms into fiber-like rib components. The rib components are then assembled to form rib/channel structures suitable for flat panel displays.

U.S. Patent Application Publication 2001/0028216 (Tokai et al.) discloses a group of elongated illuminators in a gas discharge device.

U.S. Pat. No. 6,255,777 (Kim et al.) and U.S. Patent Application Publication 2002/0017863 (Kim et al.) of Plasmion disclose a capillary electrode discharge PDP device and a method of fabrication.

U.S. Pat. No. 6,545,422 (George et al.) discloses a PDP with a plurality of micro-components in a socket and sandwiched between two substrates.

Other George et al. prior art include U.S. Pat. Nos. 6,646,388 (George et al.), 6,620,012 (Johnson et al.), 6,612,889 (Green et al.), and 6,570,335 (George et al.), all incorporated herein by reference.

Published patent applications by George et al. include U.S. Patent Application Publications 2004/0004445 (George et al.), 2003/0164684 (Green et al.), 2003/0094891 (Green et al.), and 2003/0090213 (George et al.), all incorporated herein by reference.

U.S. Pat. Nos. 6,633,117 (Shinoda et al.), 6,650,055 (Ishimoto et al.), and 6,677,704 (Ishimoto et al.), disclose a PDP with elongated display tubes, all incorporated herein by reference.

European Patent 1,288,993 (Ishimoto et al.), also discloses a PDP with elongated display tubes and is incorporated herein by reference.

The following U.S. Patent Application Publications by Fujitsu Ltd. of Kawasaki disclose PDP structures with elongated display tubes and are incorporated herein by reference:

U.S. 2004/0033319 (Yamada et al.),
U.S. 2003/0214223 (Ishimoto et al.),
U.S. 2003/0214224 (Awamoto et al.)
U.S. 2003/0214225 (Yamada et al.),
U.S. 2003/0184212 (Ishimoto et al.),
U.S. 2003/0182967 (Tokai et al.),
U.S. 2003/0180456 (Yamada et al.),
U.S. 2003/0122485 (Tokai et al.),
U.S. 2003/0052592 (Shinoda et al.),
U.S. 2003/0049990 (Yamada et al.),
U.S. 2003/0048077 (Ishimoto et al.),
U.S. 2003/0048068 (Yamada et al.),
U.S. 2003/0042839 (Ishimoto et al.),
U.S. 2003/0025451 (Yamada et al.),
U.S. 2003/0025440 (Ishimoto et al.).

As used herein elongated tube is intended to include capillary, filament, filamentary, illuminator, hollow rods, or other such terms. It includes an elongated enclosed gas filled structure having a length dimension which is greater than its cross-sectional width dimension. The width of the tube is typically the viewing direction of the display.

SUMMARY OF INVENTION

This invention relates to the selective placement of one or more Plasma-shells on a substrate and electrically connecting each Plasma-shell to at least two electrical conductors such as electrodes. An electrically conductive bonding substance is applied to each Plasma-shell so as to form an electrical connection pad to each electrode. A clearance space is provided to prevent the flow and wicking of electrically conductive bonding substances from one pad to another. In one embodiment each Plasma-shell is positioned within an opening in the substrate such as a hole, well, cavity, slot, channel, groove, or the like which extends partially or completely through the substrate. The Plasma-shell may be of any suitable geometric shape and may be used alone or in combination with a Plasma-tube. As used herein, Plasma shell includes Plasma-sphere, Plasma-disc, and Plasma-dome. Combinations of Plasma-shells of different sizes and shapes may be used.

A Plasma-sphere is a primarily hollow sphere with relatively uniform shell thickness. The shell is typically composed of a dielectric material. It is filled with an ionizable gas at a desired mixture and pressure. The gas is selected to produce visible, UV, and/or infrared discharge when a voltage is applied. The shell material is selected to optimize dielectric properties and optical transmissivity. Additional beneficial materials may be added to the inside or outer surface of the sphere including magnesium oxide for secondary electron emission. The magnesium oxide and other materials including organic and/or inorganic luminescent substances may also be added directly to the shell material.

A Plasma-disc is similar to the Plasma-sphere in material composition and gas selection. It differs from the Plasma-sphere in that it is flattened on both the top and bottom. A Plasma-sphere or sphere may be flattened to form a Plasma-disc by applying heat and pressure simultaneously to the top and bottom of the sphere using two substantially flat and ridged members, either of which may be heated. Each of the other four sides may be flat or round.

A Plasma-dome is similar to a Plasma-sphere in material composition and ionizable gas selection. It differs in that one side is domed. A Plasma-sphere is flattened on one or more other sides to form a Plasma-dome by applying heat and pressure simultaneously to the top and bottom of the Plasma-sphere or sphere using one substantially flat and ridged member and one substantially elastic member. In one embodiment, the substantially rigid member is heated. A Plasma-dome may also be made by cutting an elongated tube as shown in U.S. Pat. No. 3,998,618 (Kreick et al.) incorporated herein by reference.

In accordance with the practice of this invention, the gas discharge space within a gas discharge plasma display device comprises one or more Plasma-shells, each Plasma-shell containing an ionizable gas mixture capable of forming a gas discharge when a sufficient voltage is applied to opposing electrodes in close proximity to the tube.

In one embodiment, this invention comprises Plasma-shells containing ionizable gas in a monochrome or multicolor gas discharge (plasma) display wherein photons from the gas discharge within a Plasma-shell excite a phosphor such that the phosphor emits light in the visible and/or invisible spectrum including photons in the UV and/or IR range. The invention is described hereinafter with reference to a plasma display panel (PDP) in an AC gas discharge (plasma) display.

The practice of this invention provides a Plasma-shell PDP with a robust cell structure that is free from problems associated with dimensional tolerance requirements in the prior art.

The practice of this invention also provides for plasma display devices to be produced with simple alignment methods using non-rigid, flexible, or bendable substrates made from materials such as polymers, plastics, or the like.

The practice of this invention provides for low cost manufacturing processes such as continuous roll manufacturing processes by separating the manufacture of the light producing Plasma-shell elements from the manufacture of the substrate.

The practice of this invention provides for the simultaneous addressing of multiple rows of pixels without physically dividing or separating the display screen as is done with conventional plasma displays.

This invention provides for the improved priming or conditioning of pixels.

The practice of this invention provides for the reduction of false contour that is often observed in a standard plasma display.

The practice of this invention also provides for a positive column plasma gas discharge device having increased brightness and improved luminous efficiency.

DETAILED DESCRIPTION OF DRAWINGS AND EMBODIMENTS OF INVENTION

In accordance with this invention, at least two electrodes or conductors are electrically connected to a Plasma-shell located on a substrate by means of an electrically conductive bonding substance applied to each Plasma-shell, each electrically conductive bonding substance connection to each Plasma-shell being separated from each other electrical conductive bonding substance connection on the Plasma-shell by a clearance space such as one or more slots or channels to prevent the conductive substance forming one electrical connection from flowing or wicking and electrically shorting out another electrical connection. Each Plasma-shell may be positioned in an opening in the substrate such as a hole, well, cavity, or the like that may extend partially or completely through the substrate. The clearance space may be integrated into or an extension of the opening. As used herein, Plasma-shell includes Plasma-sphere, Plasma-disc, and Plasma-dome.

Figure 1A:
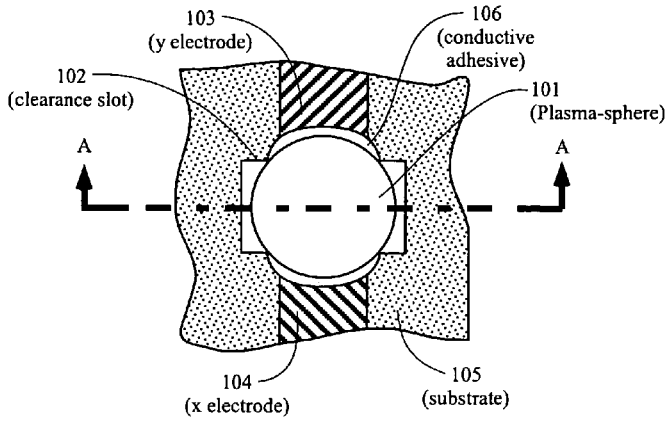
FIG. 1A is a top view of a Plasma-sphere mounted on a substrate with two electrodes and clearance slots.
Figure 1B:
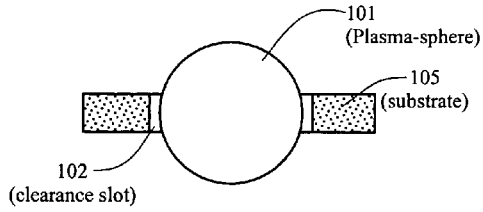
FIG. 1B is an orthogonal Section View A-A of FIG. 1A.

In one embodiment of this invention, a gas filled Plasma-sphere is used as the pixel or sub-pixel element of a single substrate PDP device as shown in FIGS. 1A and 1B. As shown in FIG. 1A, the Plasma-sphere 101 is positioned in a hole or well on a PDP substrate 105 and is composed of a material selected to have the properties of tranmissivity to light, while being sufficiently impermeable as to the ionizable gas confined within the Plasma-sphere. The gas is selected so as to discharge and produce light in the visible or invisible range when a voltage is applied to electrodes 103 and 104. The PDP substrate 105 may be constructed of a rigid or flexible material. It may be opaque, transparent, translucent, or non-light transmitting. In the case where the discharge of the ionizable gas produces photons, a photon excitable organic and/or inorganic luminescent substance such as a photoluminescent phosphor is applied to the exterior or interior of the Plasma-sphere 101 or embedded within the shell of the Plasma-sphere to produce light. Besides phosphors, other materials may be applied to the interior and exterior of the Plasma-sphere to enhance contrast, and/or to decrease operating voltage. One such material contemplated in the practice of this invention is a secondary electron emitter material such as magnesium oxide. Magnesium oxide is used in PDP construction to decrease the PDP operating voltages.

Figure 1C:
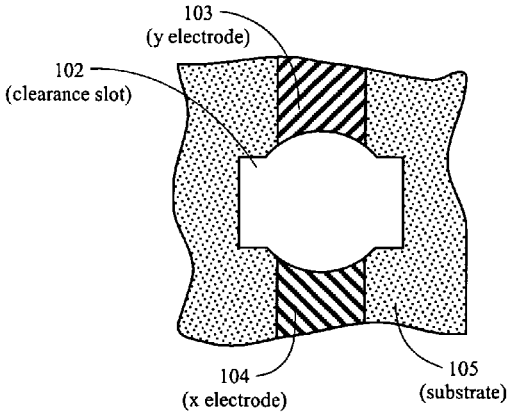
FIG. 1C is a top view of the substrate without the Plasma-sphere.

FIG. 1A is a top view of a Plasma-sphere mounted on a substrate, and FIG. 1B is an orthogonal Section View A-A of FIG. 1A. Together FIGS. 1A and 1B show a Plasma-sphere 101 mounted within a hole in a substrate 105 and bonded to electrodes 103 and 104 with a conductive adhesive 106. When a conventional cylindrical hole is used, conductive adhesive 106 wicks uncontrollably by capillary action around the Plasma-sphere 101 degrading performance as well as possibly electrically shorting the electrodes 103 and 104. A clearance slot 102 internal to the Plasma-sphere mounting hole (not numbered) controls the wicking action and, in turn, the area and location of the conductive electrode bond connection to the Plasma-sphere. The shape of the clearance slot 102 with the mounting hole is shown in FIG. 1C which is a top view of the substrate 105 without the Plasma-sphere 101. As shown there are two clearance 102 slots on opposite sides of the holes to prevent flow or wicking of the conductive adhesive 106.

FIG. 1A shows Plasma-sphere 101 bonded to y electrode 103 and x electrode 104, and a mounting hole through substrate 105. The hole through 105 is circular conforming to the shape of the sphere in the area of the electrodes. In between the electrodes, a larger rectangular clearance slot 102 is superimposed so as to enlarge the portion of the cylindrical hole between the electrodes. The Plasma-sphere is conductively bonded to each of the electrodes with conductive adhesive 106.

FIG. 1B shows a Section View A-A through Plasma-sphere 101, substrate 105, and clearance slot 102 illustrating the conductive adhesive electrode foot print interface to Plasma-sphere 101. Consistency of interface area, position and electrical characteristics are important for display performance and image uniformity. Conductive adhesive bonding between substrate electrode conductors and the Plasma-sphere is important. Without the intimate contact, firing voltages will be excessively high and non-uniform which is not consistent with requirements needed for image display.

Figure 2A:
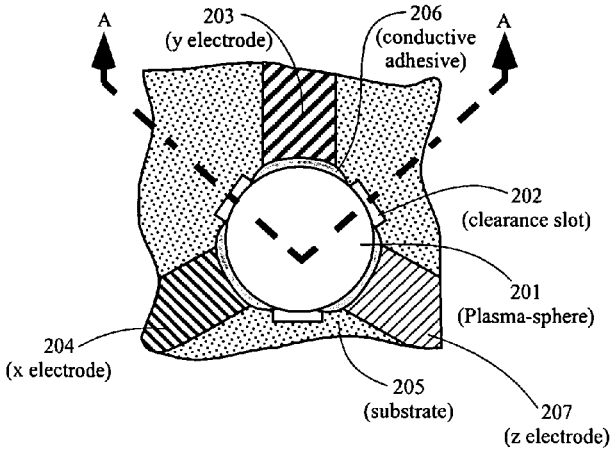
FIG. 2A is a top view of a Plasma-sphere mounted on a substrate with three electrodes and clearance slots.
Figure 2B:
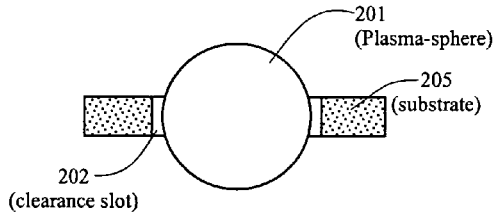
FIG. 2B is an orthogonal Section View A-A of FIG. 2A.
Figure 2C:
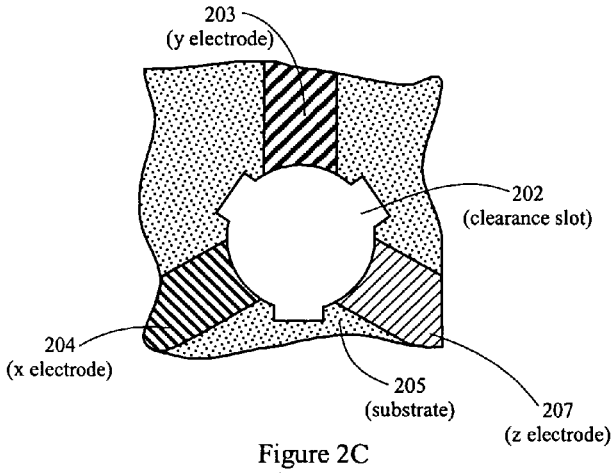
FIG. 2C is a top view of the substrate without the Plasma-sphere.

FIG. 2A is a top view of a single plasma sphere pixel element illustrating Plasma-sphere 201 bonded to y electrode 203, x electrode 204, and z electrode 207 and a mounting hole (not numbered) through substrate 205. The hole through 205 is circular conforming to the shape of the sphere in the area of the electrodes. In between electrodes, a "Y" shaped rectangular clearance slot 202 is superimposed on the circular hole to ensure electrical separation of the electrodes. The Plasma-sphere 201 is conductively bonded to each of the electrodes with conductive adhesive 206 so as to control bond position and contact area. FIG. 2B shows a Section View A-A through plasma sphere 201, substrate 205, and clearance slot 202 illustrating the superposed conductive adhesive electrode foot print 206 interface to plasma sphere 201. Consistency of interface area, position and electrical characteristics are important for display performance and image uniformity. The shape of the clearance slot 202 is shown in FIG. 2C which is a top view of the substrate 205 without the Plasma-sphere 201. As shown there are three clearance slots 202 to prevent flow or wicking of the conductive adhesive 206.

Figure 3A:
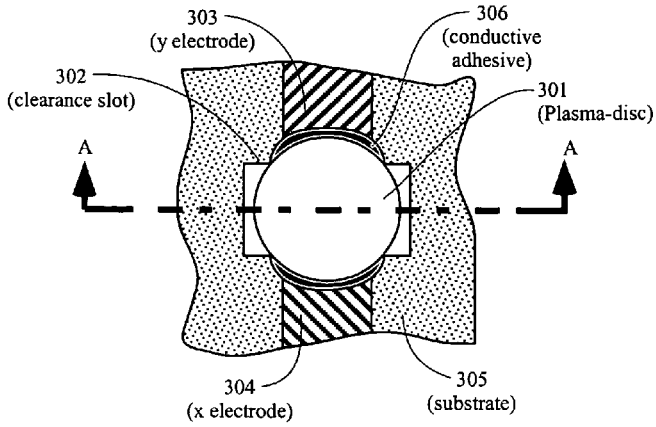
FIG. 3A is a top view of a Plasma-disc mounted on a substrate with two electrodes and a clearance slots.
Figure 3B:
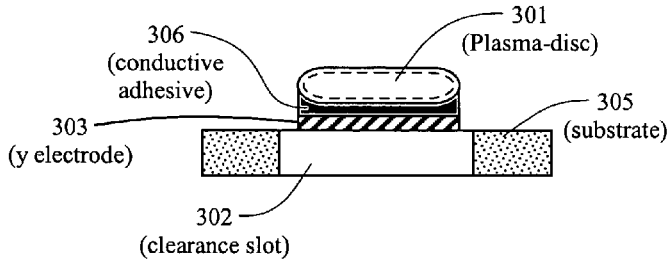
FIG. 3B is an orthogonal Section View A-A of FIG. 3A.
Figure 3C:
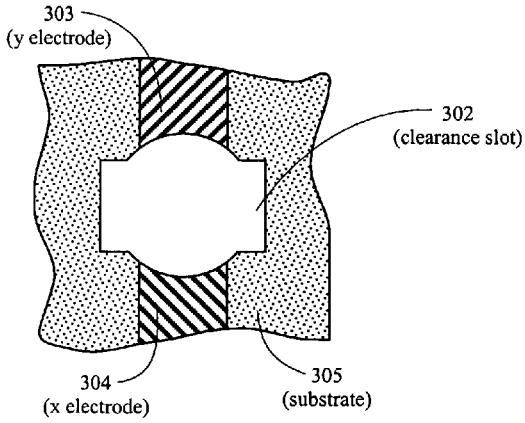
FIG. 3C is a top view of the substrate without the Plasma-disc.

FIG. 3A is a top view of a single Plasma-disc pixel element illustrating Plasma-disc 301 conductively bonded to y electrode 303 and x electrode 304, located on substrate 305. In between the electrodes, a rectangular clearance slot 302 is cut through the substrate so as to control the position and area of the conductive adhesive 306 that is in contact with the Plasma-disc. As shown there are two clearance slots 302. FIG. 3B shows a Section View A-A through Plasma-sphere 301, substrate 305, clearance slot 302, and conductive adhesive 306 electrically connecting the Plasma-disc 301 to the electrodes. The shape of the clearance slot 302 is shown in FIG. 3C which is the top view of the substrate 305 without the Plasma-disc 301.

Figure 4A:
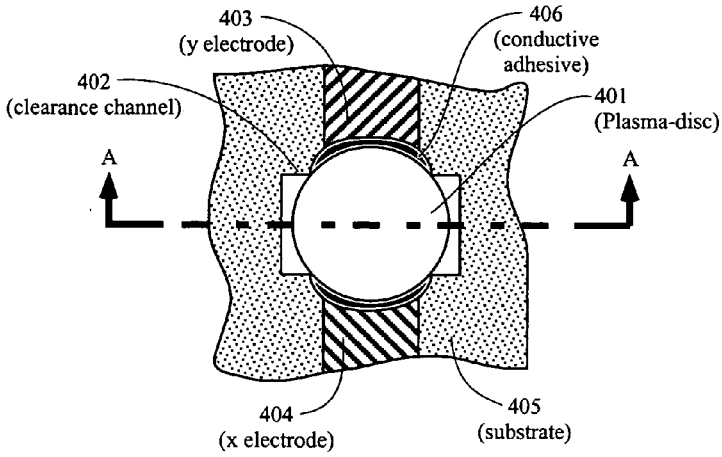
FIG. 4A is a top view of Plasma-disc mounted on a substrate with two electrodes and a clearance channel.
Figure 4B:
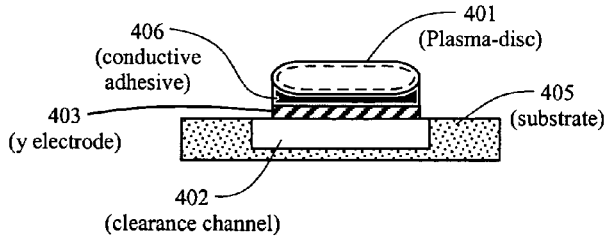
FIG. 4B is an orthogonal Section View A-A of FIG. 4A.
Figure 4C:
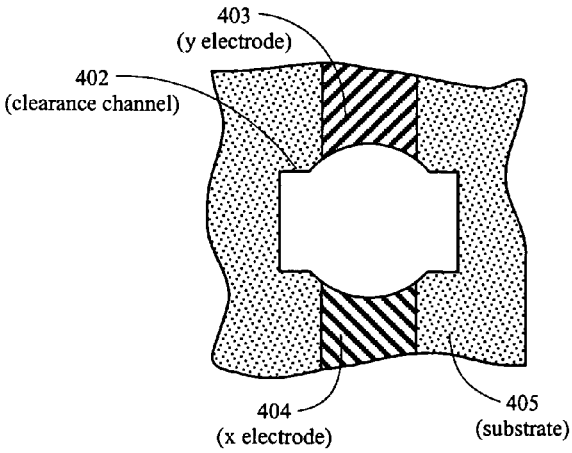
FIG. 4C is a top view of the substrate without the Plasma-disc.

FIG. 4A is a top view of a single Plasma-disc pixel element 401 bonded to y electrode 403 and x electrode 404, located on substrate 405. In between electrodes, a rectangular clearance channel 402 is cut into the substrate so as to control the position and area of the conductive adhesive 406 that is in contact with the Plasma-disc. As shown there are three clearance channels 402. These do not extend completely through the substrate 405. FIG. 4B shows a Section View A-A through Plasma-disc 401, substrate 405, and clearance slot 402 illustrating the conductive adhesive 406 electrically connecting the Plasma-disc 401 to the electrodes. The shape of the clearance channel 402 is shown in FIG. 4C which is the top view of the substrate 405 without the Plasma-disc 401.

Figure 5A:
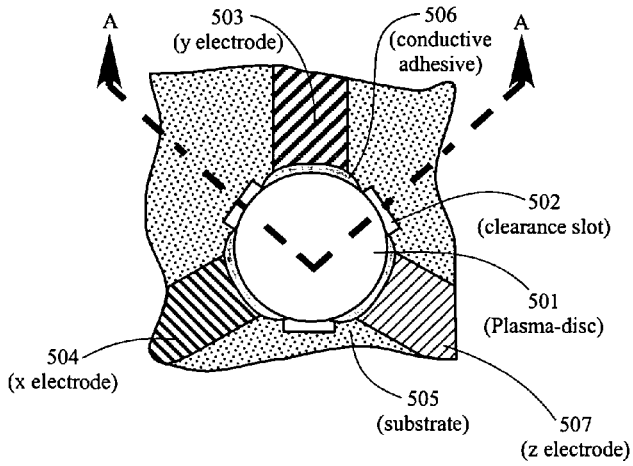
FIG. 5A is a top view of a Plasma-disc mounted on a substrate with three electrodes and clearance slots.
Figure 5B:
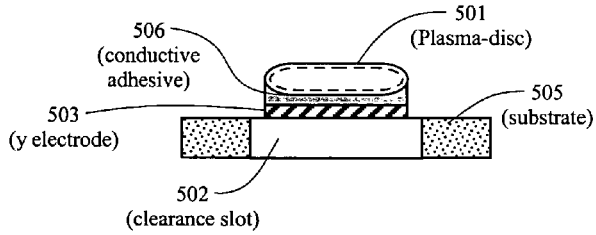
FIG. 5B is an orthogonal section of view A-A of FIG. 5A.
Figure 5C:
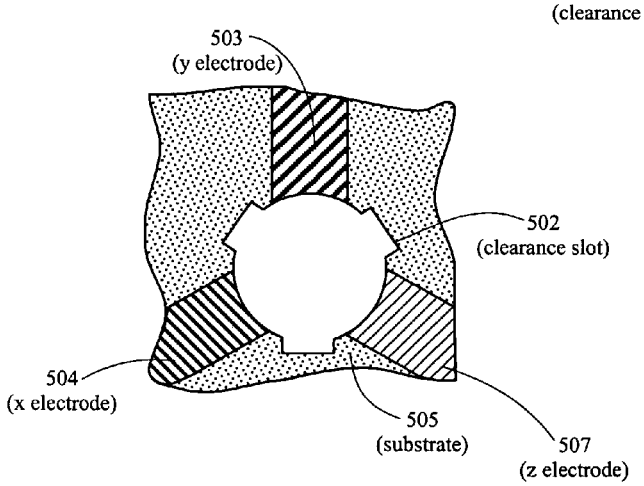
FIG. 5C is a top view of the substrate without the Plasma-disc.

FIG. 5A is a top view of a single Plasma-disc pixel element illustrating Plasma-disc 501 bonded to y electrode 503, x electrode 504, and z electrode 507 located on substrate 505. The hole through 505 conforms to the shape of the Plasma-disc in the area of the electrodes. In between electrodes, a "Y" shaped clearance slot 502 is superimposed on the hole so as to enlarge the portion of the hole between the electrodes. As shown there are three clearance slots 502. The Plasma-disc is conductively bonded to each of the electrodes with conductive adhesive 506. FIG. 5B shows a Section View A-A through Plasma-disc 501, substrate 505, clearance slot 502, and the conductive adhesive 506 electrically connecting the electrode interface to Plasma-disc 501 to the electrodes. The shape of the clearance slot 502 is shown in FIG. 5C which is the top view of the substrate 505 without the Plasma-disc 501.

Figure 6A:
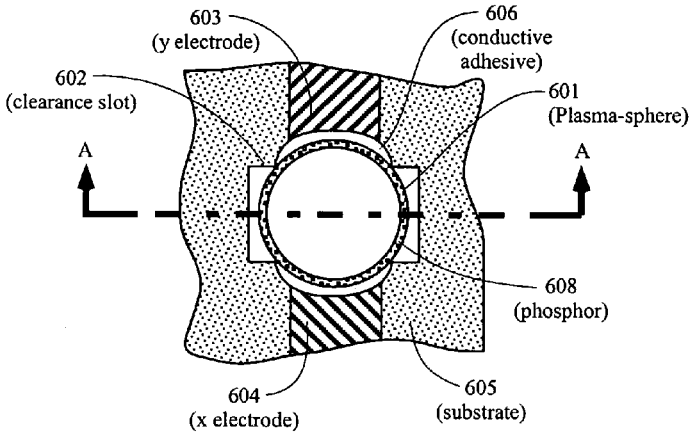
FIG. 6A is a top view of a Plasma-sphere mounted on a substrate with two electrodes, clearance slots, and phosphor.
Figure 6B:
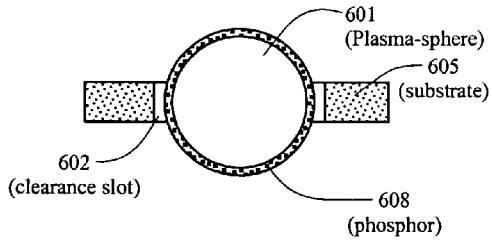
FIG. 6B is an orthogonal Section View A-A of FIG. 6A.

FIG. 6A is a top view of a single Plasma-sphere pixel element illustrating Plasma sphere 601 bonded to y electrode 603, x electrode 604, a phosphor coating 608, and substrate 605. The hole (not numbered) through 605 is circular conforming to the shape of the sphere in the area of the electrodes. In between electrodes, a rectangular clearance slot 602 is superimposed so as to provide clear separation of the electrodes. As shown there are two clearance slots 602. FIG. 6B shows a Section View A-A through Plasma-sphere 601, phosphor 608, substrate 605, and clearance slot 602. Phosphor 608 may be coated on the entire surface of the sphere or on a portion thereof.

Figure 6C:
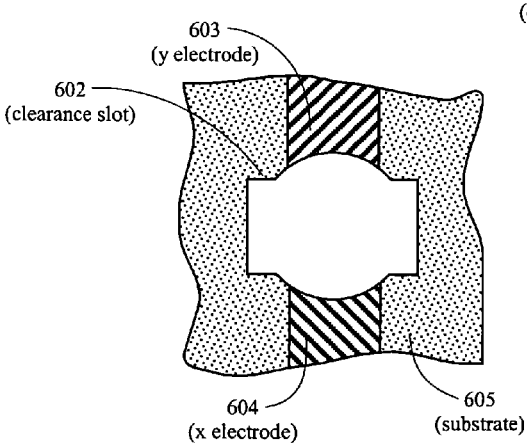
FIG. 6C is a top view of the substrate without the Plasma-sphere.

The shape of the clearance slot 602 is shown in FIG. 6C which is the top view of the substrate 605 without the Plasma-sphere 601.

Figure 7A:
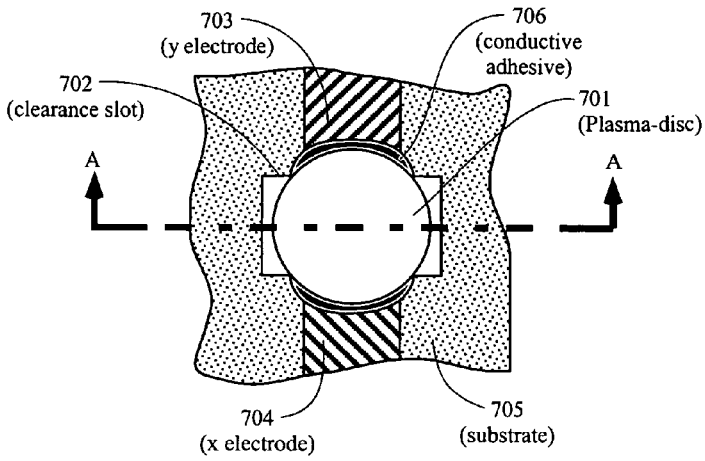
FIG. 7A is a top view of a Plasma-disc mounted on a substrate with two electrodes, clearance slots, and phosphor.
Figure 7B:
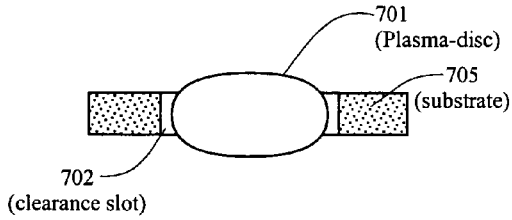
FIG. 7B is an orthogonal Section View A-A of FIG. 7A.
Figure 7C:
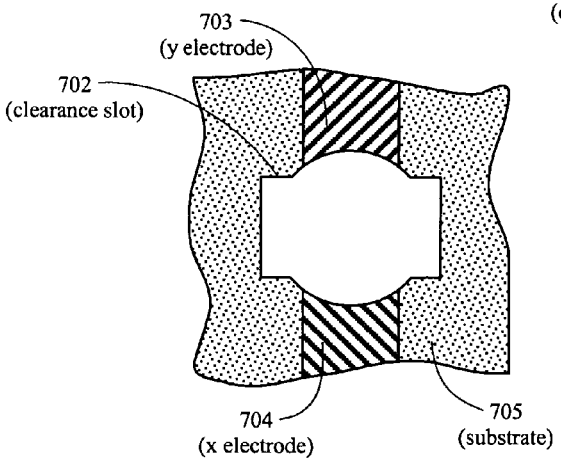
FIG. 7C is a top view of the substrate without the Plasma-disc.

FIG. 7A is a top view of a single Plasma-disc pixel element illustrating Plasma-sphere 701 bonded to y electrode 703, x electrode 704, and substrate 705. The hole through 705 is circular conforming to the shape of the disc in the area of the electrodes. In between electrodes, a larger rectangular clearance slot 702 is superimposed so as to provide clear separation of the electrodes. As shown there are two clearance slots 702. FIG. 7B shows a Section View A-A through Plasma-disc 701, substrate 705, conductive adhesive 706, and clearance slot 702. The shape of the clearance slot 702 is shown in FIG. 7C which is the top view of the substrate 705 without the Plasma-disc 701.

Figure 8A:
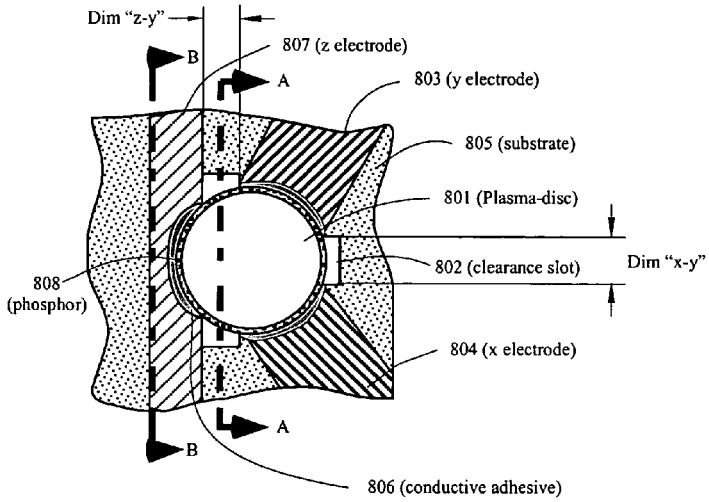
FIG. 8A is a top view of a Plasma-disc mounted on a substrate with three electrodes, clearance slots, and phosphor.
Figure 8B:
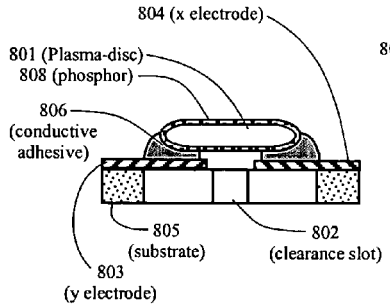
FIG. 8B is an orthogonal Section View A-A of FIG. 8A.
Figure 8C:
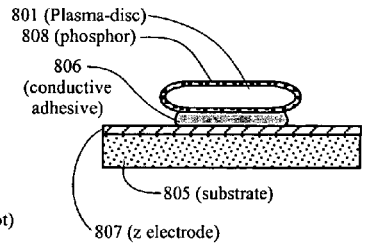
FIG. 8C is an orthogonal Section View B-B of FIG. 8A.
Figure 8D:
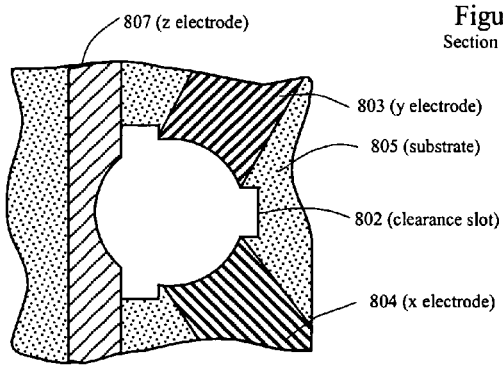
FIG. 8D is a top view of the substrate without the Plasma-disc.

FIG. 8A is a top view of a single Plasma-disc pixel element illustrating Plasma-disc 801, phosphor 808, y electrode 803, x electrode 804, z electrode 807, and substrate 805. In between the electrodes is a "Y" or "T" shaped clearance slot 802 to physically separate each of the three electrodes from one another. As shown there are three clearance slots 802. The Plasma-disc is conductively bonded to each of the electrodes with conductive adhesive 806. FIG. 8B shows a Section View A-A through Plasma-disc 801, phosphor 808, substrate 805, and clearance slot 802 illustrating the conductive adhesive 806 connections to Plasma-disc 801. FIG. 8C shows a Section View B-B through substrate 805 and z electrode 807. The arrangement of the electrodes provides a variable separation between electrodes 803 and 804 so that a Plasma-discharge may be initiated at a minimum separation distance [Dim "x-y" min and spread to a longer length Dim "x-y" min)] during the course of a discharge cycle. This longer Plasma-discharge length may provide greater discharge luminous efficiency when supported by appropriate electronic drive circuitry such as used in the "positive column" discharge operation of the PDP. The shape of the clearance slot 802 is shown in FIG. 8D which is the top view of the substrate 805 without the Plasma-disc 801.

Figure 9A:
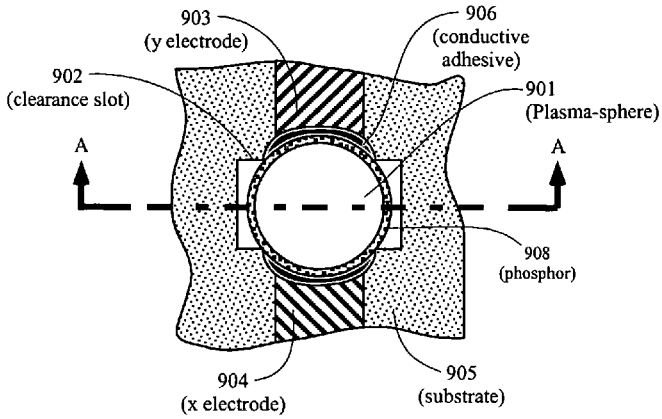
FIG. 9A is a top view of a Plasma-sphere mounted on a substrate with two electrodes, clearance slots, and phosphor.
Figure 9B:
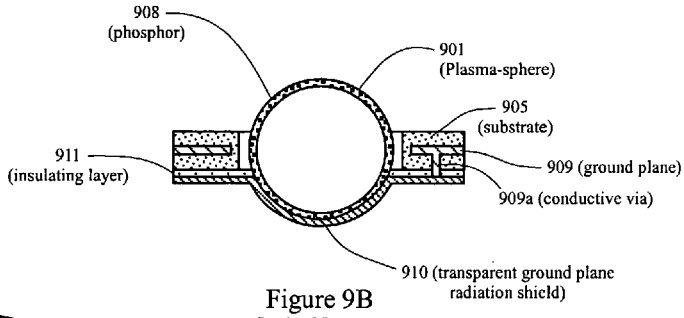
FIG. 9B is an orthogonal Section View A-A of FIG. 9A showing a ground plane and radiation shield.
Figure 9C:
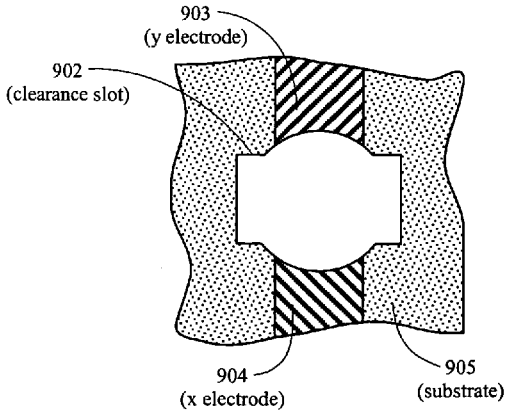
FIG. 9C is a top view of the substrate without the Plasma-sphere.

FIG. 9A is a top view of a single Plasma-sphere pixel element illustrating Plasma-sphere 901, y electrode 903, x electrode 904, and substrate 905. The hole through 905 is circular conforming to the shape of the sphere in the area of the electrodes. In between electrodes, a larger rectangular clearance slot 902 is superimposed so as to enlarge the portion of the cylindrical hole between the electrodes. As shown there are two clearance slots 902. Plasma-spheres are conductively bonded to each of the electrodes with conductive adhesive 906. Phosphor 908 may be coated on the entire surface of the sphere or on a portion thereof. FIG. 9B shows a Section View A-A through Plasma-sphere 901, substrate 905, and clearance slot 902 with a transparent ground plane radiation shield 910 connected by via 909*a* to ground plane 909. An insulating layer 911 may be separately applied to Plasma-sphere 901. The insulating layer 911 prevents contact between 909 and 910. The shape of the clearance slot 902 is shown in FIG. 9C which is the top view of the substrate 905 without the Plasma-sphere 901.

Figure 10A:
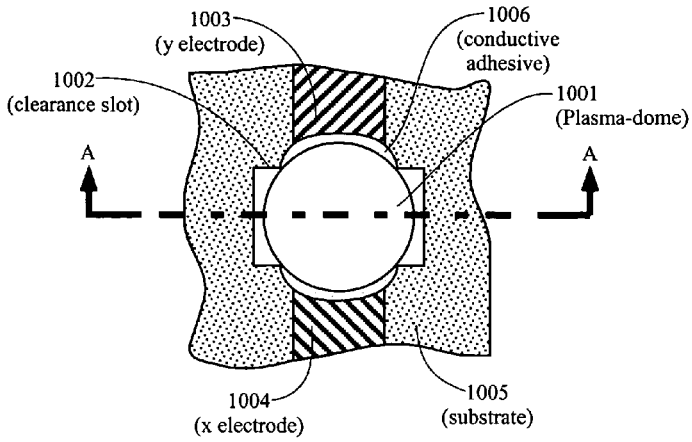
FIG. 10A is a top view of a Plasma-dome mounted on a substrate with two electrodes and clearance slots.
Figure 10B:
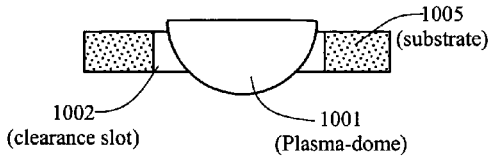
FIG. 10B is an orthogonal Section View A-A of FIG. 10A.
Figure 10C:
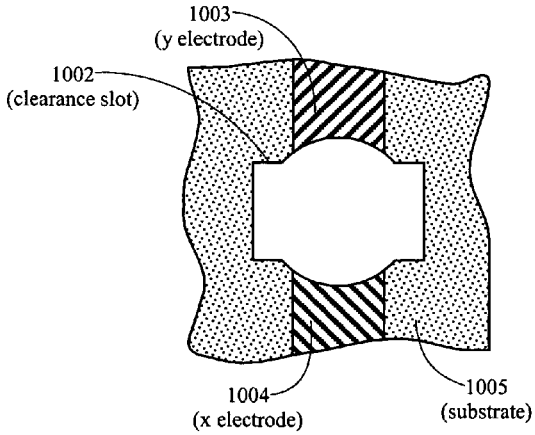
FIG. 10C is a top view of the substrate without the Plasma-dome.

FIG. 10A is a top view of a single Plasma-dome pixel element illustrating Plasma-dome 1001, y electrode 1003, x electrode 1004, and substrate 1005. The mounting hole through 1005 is circular conforming to the shape of the dome in the area of the electrodes. In between electrodes, a larger rectangular clearance slot 1002 provides clear separation of the electrodes. As shown there are two clearance slots 1002. FIG. 2010B shows a Section View A-A through Plasma-dome 1001, substrate 1005, and clearance slot 1002 showing the conductive adhesive 1006 connected to Plasma-dome 1001. The shape of the clearance slot 1002 is shown in FIG. 10C which is the top view of the substrate 1005 without the Plasma-dome 1001.

Figure 11A:
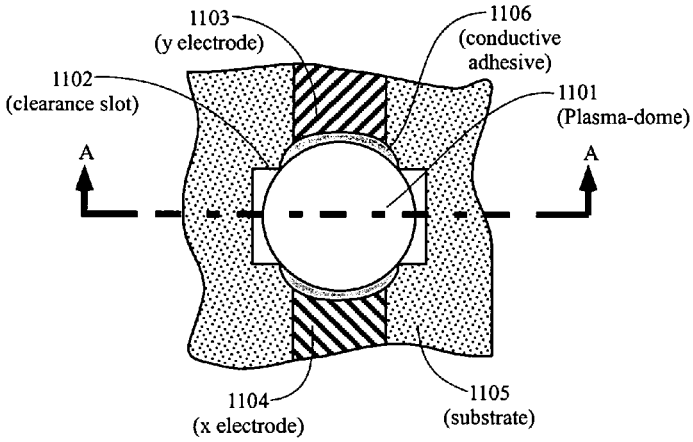
FIG. 11A is a top view of a Plasma-dome mounted on a substrate with two electrodes and clearance slots.
Figure 11B:
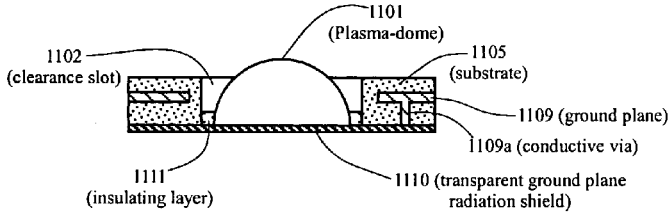
FIG. 11B is an orthogonal Section View A-A of FIG. 11A.
Figure 11C:
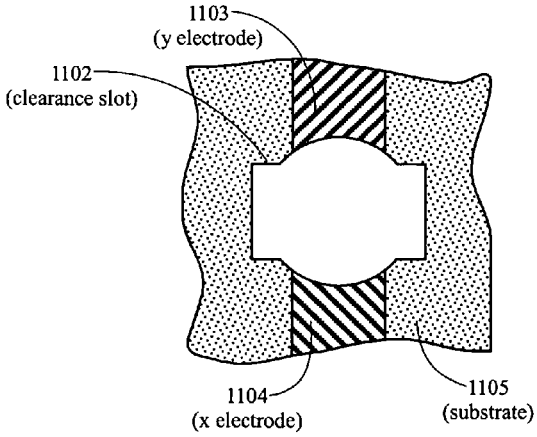
FIG. 11C is a top view of the substrate without the Plasma-dome.

FIG. 11A is a top view of a single Plasma-dome pixel element illustrating Plasma-dome 1101, y electrode 1103, x electrode 1104, and substrate 1105. The Plasma-dome mounting hole through 1105 is circular conforming to the shape of the dome in the area of the electrodes. In between electrodes, a larger rectangular clearance slot 1102 is superimposed so as to provide clear separation of the electrodes. As shown there are two clearance slots 1102. FIG. 11B shows a Section View A-A through Plasma-dome 1101, substrate 1105, and clearance slot 1102 with conductive via 1110 on the viewing side that is grounded with insulating layer 1111 and substrate ground layer 1109. Also shown is transparent ground plane radiation shield 1110. The shape of the clearance slot 1102 is shown in FIG. 11C which is the top view of the substrate 1105 without the Plasma-dome 1101.

Figure 12A:
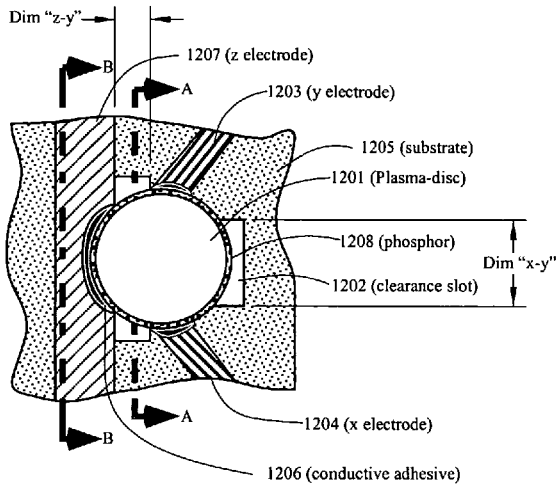
FIG. 12A is a top view of a Plasma-disc mounted on a substrate with three electrodes and clearance slots.
Figure 12B:
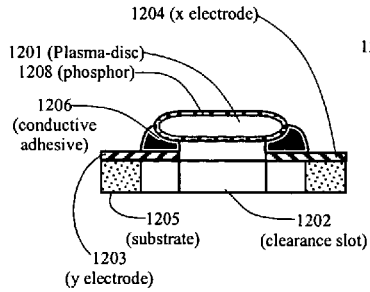
FIG. 12B is a Section View of A-A of FIG. 12A.
Figure 12C:
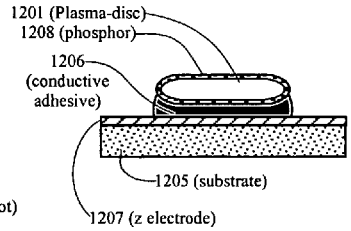
FIG. 12C is a Section View B-B of FIG. 12A.
Figure 12D:
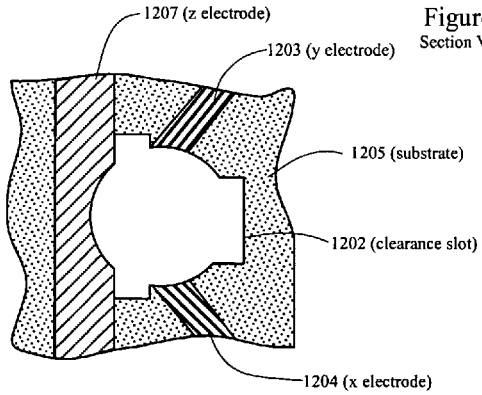
FIG. 12D is a top view of the substrate without the Plasma-disc.

FIG. 12A is a top view of a Plasma-disc 1201 mounted on a substrate 1205. FIG. 12B is an orthogonal Section View A-A through the Plasma-disc. FIG. 12C is an orthogonal Section View B-B through the substrate and electrode 1207. Together they show a Plasma-disc mounted onto a substrate surface and bonded to three electrodes with a conductive adhesive 1206. The arrangement of the electrodes shown provides a long plasma discharge length (greater than 400 micro meters) to enable a "positive column" discharge. The operation of a "positive column" plasma discharge may be likened to the highly efficient output of a fluorescent light bulb. Favorable conditions for "positive column" discharge occur when the gap between the two sustain electrodes 1203 and 1204, i.e., Dim "x'-y", is much larger than the gap between the sustain electrodes and the address electrode 1207, i.e., Dim "z-y" and appropriate drive voltages applied to each of the electrodes. The shape of the clearance slot 1202 is shown in FIG. 12C which is the top view of the substrate 1205 without the Plasma-disc 1201. As shown there are three clearance slots 1202.

Figure 13A:
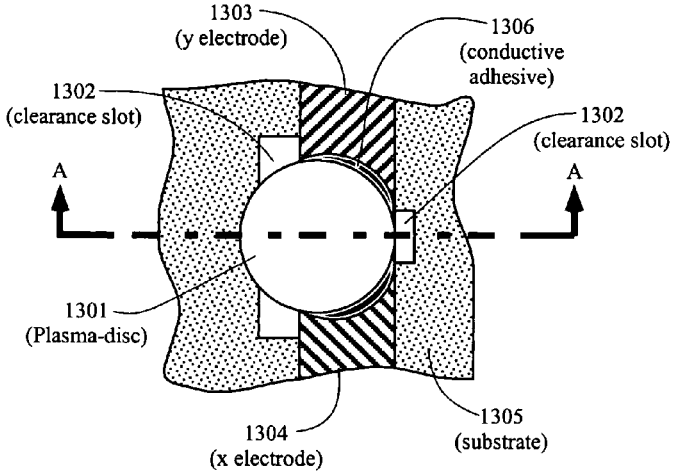
FIG. 13A is a top view of a Plasma-disc with two electrodes and clearance slots.
Figure 13B:
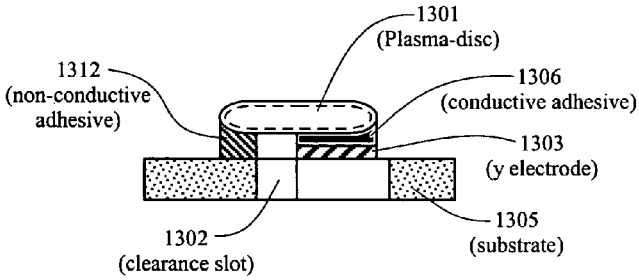
FIG. 13B is a Section View A-A of FIG. 13A.
Figure 13C:
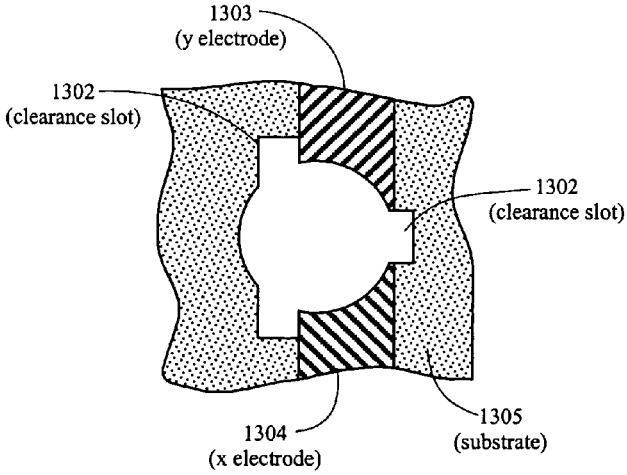
FIG. 13C is a top view of the substrate without the Plasma-disc.

FIG. 13A is a top view of a single Plasma-disc pixel element showing Plasma-disc 1301, y electrode 1303, and x electrode 1304. A "T" shaped clearance slot 802 isolates the x and y electrodes so as to physically separate each electrode from the other. The Plasma-disc is conductively bonded to each of the electrodes with conductive adhesive 1306. If a portion of the disc is left unsupported, it may be bonded to the substrate 1305 with non-conductive adhesive 1312. FIG. 13B shows a Section View A-A through Plasma-disc 1301, substrate 1305, clearance slot 1302, and conductive adhesive 1306. The arrangement of the electrodes provides a variable separation between sustain electrodes 1303 and 1304 so that a plasma discharge may be initiated at a minimal separation distance and spread to a larger length during the course of a discharge cycle such as in the "positive column" discharge operation of the PDP. This longer plasma discharge length may provide greater discharge luminous efficiency when supported by appropriate electronic drive circuitry. The shape of the clearance slot 1302 is shown in FIG. 13C which is the top view of the substrate 1305 without the Plasma-disc 1301. As shown there are three clearance slots 1302.

Figure 14:
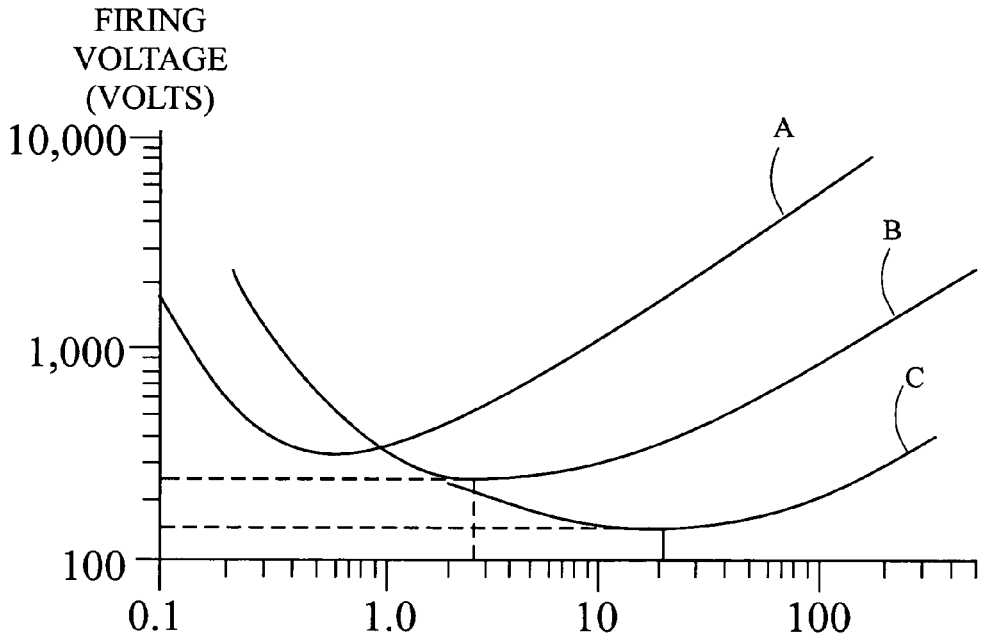
FIG. 14 shows illustrative Paschen curves for ionizable gas mixtures.

The Plasma-shell, including Plasma-sphere, Plasma-disc, or Plasma-dome is filled with an ionizable gas. Each gas composition or mixture has a unique curve associated with it, called the Paschen curve as illustrated in FIG. 14. The Paschen curve is a graph of the breakdown voltage versus the product of the pressure times the discharge distance. It is usually given in Torr-centimeters. As can be seen from the illustration in FIG. 14, the gases typically have a saddle region in which the voltage is at a minimum. Often it is desirable to choose pressure and distance in the saddle region to minimize the voltage. In the case of a Plasma-sphere, the distance is the diameter of the sphere or some chord of the sphere as defined by the positioning of the electrodes. The gas pressure at ambient room temperature inside the Plasma-sphere is selected in accordance with this diameter or core distance.

Knowing the desired pressure $P_1$ at ambient temperature $T_1$, one can calculate the pressure at the heating temperatures using the ideal gas law where $$P_1/T_1=P_2/T_2 \text{ such that}$$

$$P_1=P_2T_1/T_2$$

$P_2$ is the desired pressure of the gas inside a sealed microsphere at ambient temperature $T_2$, $T_1$ is the sealing and gas filing temperature, and $P_1$ is the gas pressure at $T_1$. For example, if a microsphere is filled with gas at 1600° C., the desired gas is maintained at a pressure of about 6 times greater then the desired pressure. For a mixture of 99.99% atoms Neon and 0.01% atoms Argon with a Paschen minimum of about 10 Torr cm, and a sphere with a diameter of about 0.1 cm with electrodes positioned across the diameter, the desired pressure is about 100 Torr. Thus during the firing and gas filling of the spheres, the gas filling pressure of the neon-argon gas is about 600 Torr.

In one embodiment, the inside of the Plasma-shell contains a secondary electron emitter. Secondary electron emitters lower the breakdown voltage of the gas and provide a more efficient discharge. Plasma displays traditionally use magnesium oxide for this purpose, although other materials may be used including other Group IIA oxides, rare earth oxides, lead oxides, aluminum oxides, and other materials. It may also be beneficial to add luminescent substances such as phosphor to the inside or outside of the sphere.

In one embodiment and mode hereof, the Plasma-shell material is a metal or metalloid oxide with an ionizable gas of 99.99% atoms of neon and 0.01% atoms of argon or xenon for use in a monochrome PDP. Examples of shell materials include glass, silica, aluminum oxides, zirconium oxides, and magnesium oxides.

In another embodiment, the Plasma-shell contains luminescent substances such as phosphors selected to provide different visible colors including red, blue, and green for use in a full color PDP. The metal or metalloid oxides are typically selected to be highly transmissive to photons produced by the gas discharge especially in the UV range.

In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the Plasma-shell. The exterior application may comprise a slurry or tumbling process with curing, typically at low temperatures. Infrared curing can also be used. The luminescent substance may be applied by other methods or processes including spraying, ink jet, and so forth. The luminescent substance may be applied externally before or after the Plasma-shell is attached to the PDP substrate. As discussed hereinafter, the luminescent substance may be organic and/or inorganic.

Plasma-Disc

By flattening a Plasma-sphere on one or both sides, an advantage is gained in mounting the sphere to the substrate and connecting the sphere to electrical contacts. A plasma-sphere with a substantially flattened top and/or bottom is called a Plasma-disc. This flattening of the Plasma-sphere is typically done while the sphere shell is at an elevated softening temperature below the melting temperature. The flat viewing surface in a Plasma-disc increases the overall luminous efficiency of a PDP.

Figure 15A:
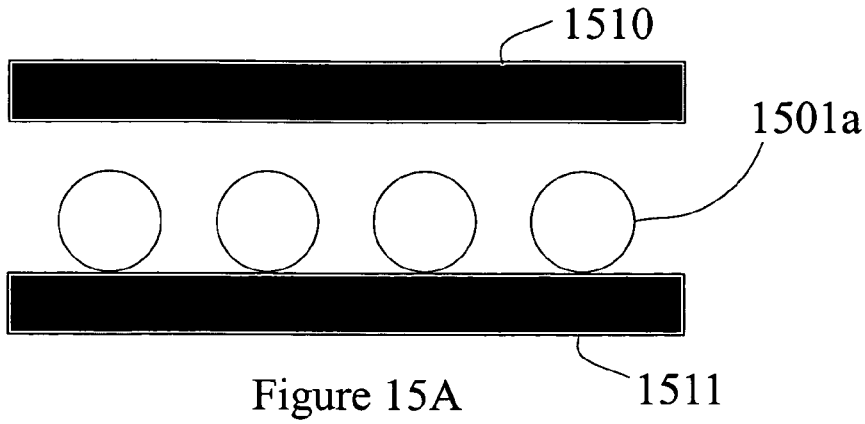
FIGS. 15A, 15B, and 15C shows method steps for the making of Plasma-discs.
Figure 15B:
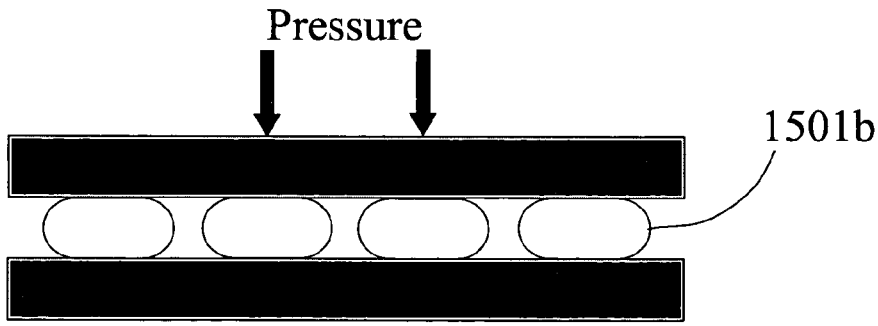
Figure 15C:
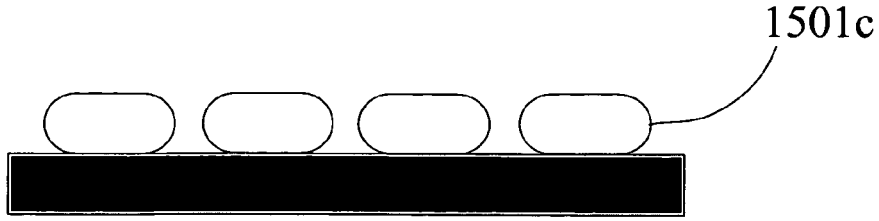

Plasma-discs are produced while the Plasma-sphere is at an elevated temperature below its melting point. While the Plasma-sphere is at the elevated temperature, a sufficient pressure or force is applied with member 1510 to flatten the spheres between members 1510 and 1511 into disc shapes with flat top and bottom as illustrated in FIGS. 15A, 15B, and 15C. FIG. 15A shows a Plasma-sphere. FIG. 15B shows uniform pressure applied to the Plasma-sphere to form a flattened Plasma-disc 1501*b*. Heat can be applied during the flattening process such as by heating members 1510 and 1511. FIG. 15C shows the resultant flat Plasma-disc 1501*c*. One or more luminescent substances can be applied to the Plasma-disc. Like a coin that can only land "heads" or "tails," a Plasma-disc with a flat top and flat bottom may be applied to a substrate in one of two positions.

Plasma-dome

Figure 16A:
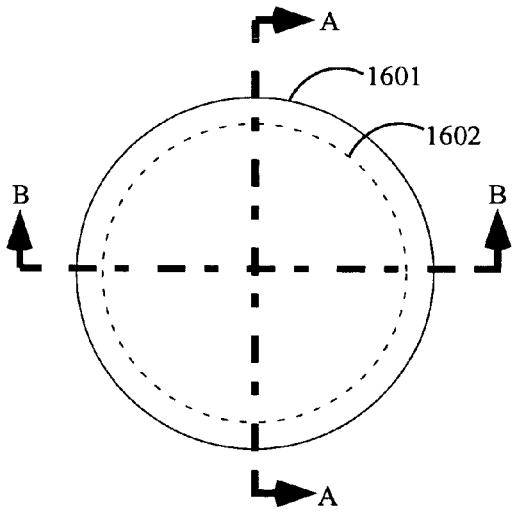
FIGS. 16A, 16B, and 16C show a Plasma-dome flattened on one side.
Figure 16B:
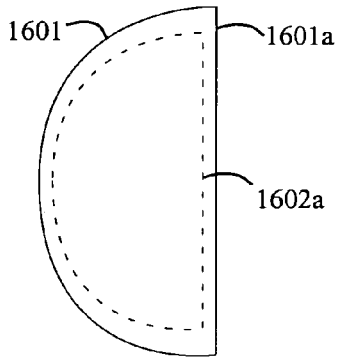
Figure 16C:
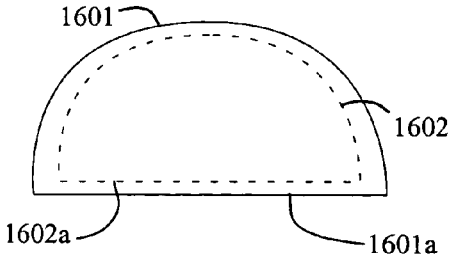

FIG. 16A is a top view of a Plasma-dome showing an outer shell wall 1601 and an inner shell wall 1602. FIG. 16B is a Section A-A view of FIG. 16A showing a flattened outer wall 1601*a* and flattened inner wall 1602*a*. FIG. 16C is a Section B-B of FIG. 16A.

Figure 17A:
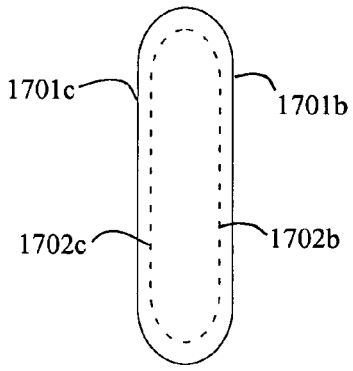
FIGS. 17A, 17B, and 17C show a Plasma-dome flattened on three sides.
Figure 17B:
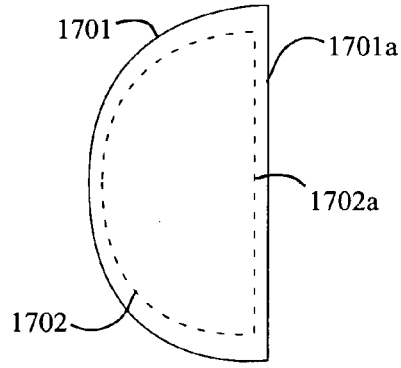
Figure 17C:
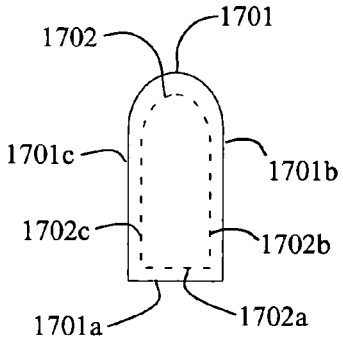

FIG. 17A is a top view of a Plasma-dome with flattened inner shell walls 1702*b* and 1702*c* and flattened outer shell wall 1701*b* and 1701*c*. FIG. 17B is a right side view of FIG. 17A showing flattened outer wall 1701*a* and flattened inner wall 1702*a* with a dome having outer wall 1701 and inner wall 1702. FIG. 17C is a bottom view of FIG. 17A.

A Plasma-disc or Plasma-dome may be flattened with heat and pressure as shown in FIGS. 15A, 15B, and 15C. It may also be made from an elongated tube or capillary structure by cutting the tube or capillary to the desired size and appropriately flattening the cut piece to the desired geometry. The tube or capillary may be filled with the ionizable gas and heat sealed during the cutting step to retain the gas.

Plasma-disc or Plasma-dome may comprise flattened microspheres and/or flattened tubes. The flattened tubes may be of any geometric shape and of any predetermined length, typically up to about 1400 micrometers.

The use of Plasma-shells such as Plasma-spheres, Plasma-discs, and Plasma-domes allow the PDP to be operated with positive column gas discharge, for example as disclosed by Weber, Rutherford, and other prior art cited herein and incorporated herein by reference. The discharge length inside the Plasma-shell must be sufficient to accommodate the length of the positive column gas discharge, generally up to about 1400 micrometers.

PDP Electronics

Figure 18:
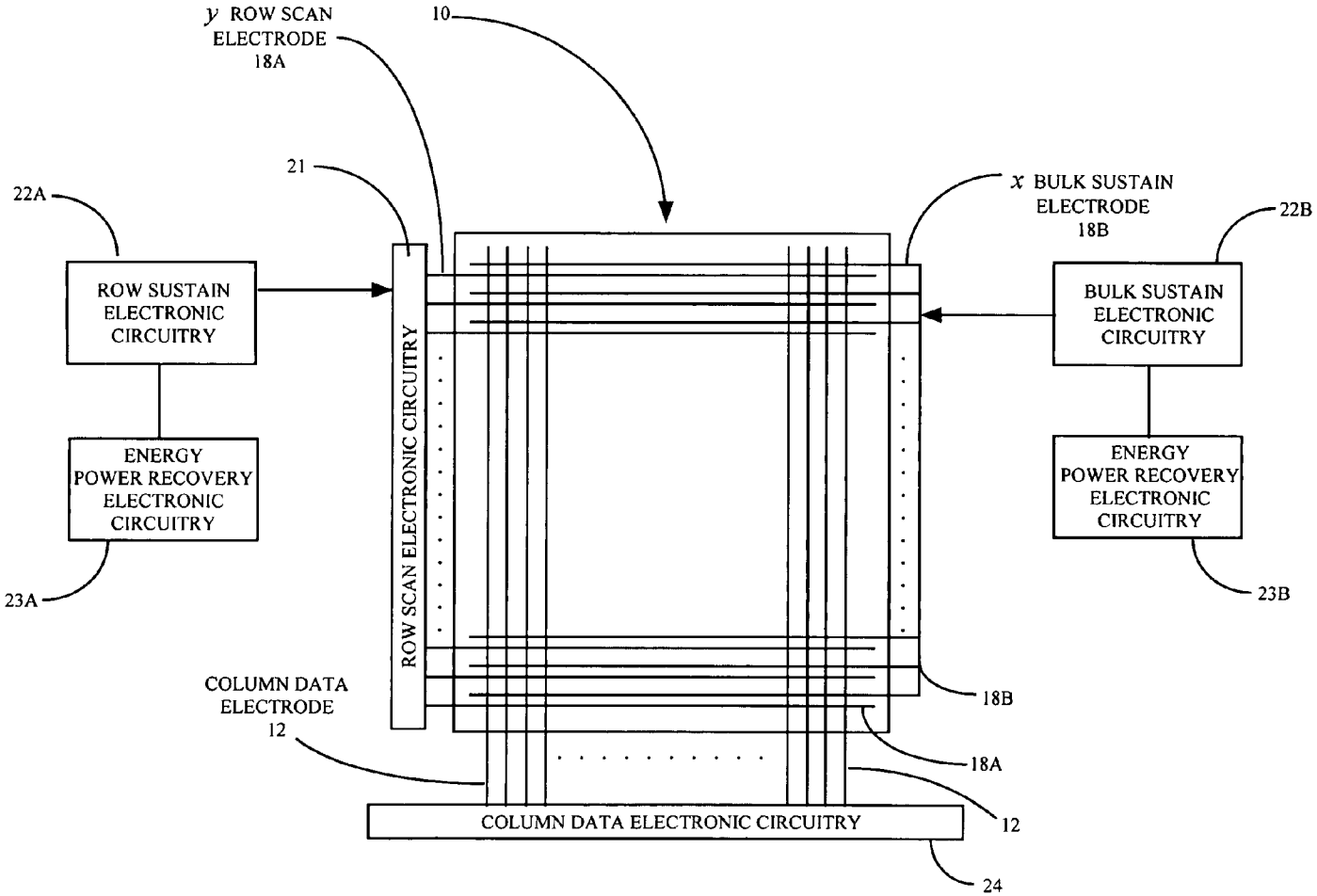
FIG. 18 shows electronics for addressing a PDP.

FIG. 18 is a block diagram of a display panel 10 with electronic circuitry 21 for y row scan electrodes 18A, bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B.

The electronics architecture used in FIG. 18 may be ADS as described in the Shinoda and other patents cited herein including U.S. Pat. No. 5,661,500. In addition, other architectures as described herein and known in the prior art may be utilized. These architectures including Shinoda ADS may be used to address the Plasma-shells

ADS

A basic electronics architecture for addressing and sustaining a surface discharge AC plasma display is called Address Display Separately (ADS). The ADS architecture may be used for a monochrome or multicolor display. The ADS architecture is disclosed in a number of Fujitsu patents including U.S. Pat. Nos. 5,541,618 and 5,724,054, both issued to Shinoda of Fujitsu Ltd., Kawasaki, Japan and incorporated herein by reference. Also see U.S. Pat. Nos. 5,446,344 (Kanazawa) and 5,661,500 (Shinoda et al.), incorporated herein by reference. ADS has become a basic electronic architecture widely used in the AC plasma display industry for the manufacture of PDP monitors and television.

Fujitsu ADS architecture is commercially used by Fujitsu and is also widely used by competing manufacturers including Matsushita and others. ADS is disclosed in U.S. Pat. No. 5,745,086 issued to Weber of Plasmaco and Matsushita, incorporated herein by reference. See FIGS. 2, 3, 11 of Weber ('086). The ADS method of addressing and sustaining a surface discharge display as disclosed in U.S. Pat. Nos. 5,541,618 and 5,724,054 incorporated herein by reference, issued to Shinoda of Fujitsu sustains the entire panel (all rows) after the addressing of the entire panel. The addressing and sustaining are done separately and are not done simultaneously. ADS may be used to address Plasma-shells.

ALIS

This invention may also use the shared electrode or electronic ALIS drive system disclosed by Fujitsu in U.S. Pat. Nos. 6,489,939 (Asso et al.), 6,498,593 (Fujimoto et al.), 6,531,819 (Nakahara et al.), 6,559,814 (Kanazawa et al.), 6,577,062 (Itokawa et al.), 6,603,446 (Kanazawa et al.), 6,630,790 (Kanazawa et al.), 6,636,188 (Kanazawa et al.), 6,667,579 (Kanazawa et al.), 6,667,728 (Kanazawa et al.), 6,703,792 (Kawada et al.), and U.S. Patent Application Publication 2004/0046509 (Sakita), all of which are incorporated herein by reference. In accordance with this invention, ALIS may be used to address the Plasma-shells.

AWD

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. Nos. 3,801,861 (Petty et al.) and 3,803,449 (Schmersal), both incorporated herein by reference. FIGS. 1 and 3 of the Shinoda 054 ADS patent discloses AWD architecture as prior art.

The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as Address While Display (AWD). See High-Luminance and High-Contrast HDTV PDP with Overlapping Driving Scheme, J. Ryeom et al., pages 743 to 746, Proceedings of the Sixth International Display Workshops, IDW 99, Dec. 1-3, 1999, Sendai, Japan and AWD as disclosed in U.S. Pat. No. 6,208,081 issued to Yoon-Phil Eo and Jeong-duk Ryeom of Samsung, incorporated herein by reference.

LG Electronics Inc. has disclosed a variation of AWD with a Multiple Addressing in a Single Sustain (MASS) in U.S. Pat. No. 6,198,476 issued to Jin-Won Hong et al. of LG Electronics, incorporated herein by reference. Also see U.S. Pat. No. 5,914,563 issued to Eun-Cheol Lee et al. of LG Electronics, incorporated herein by reference. AWD may be used to address Plasma-shells.

An AC voltage refresh technique or architecture is disclosed by U.S. Pat. No. 3,958,151 issued to Yano et al. of Nippon Electric, incorporated herein by reference. In one embodiment of this invention the Plasma-shells are filled with pure neon and operated with the architecture of Yano ('151).

Energy Recovery

Energy recovery is used for the efficient operation of a PDP. Examples of energy recovery architecture and circuits are well known in the prior art. These include U.S. Pat. Nos. 4,772,884 (Weber et al.) 4,866,349 (Weber et al.), 5,081,400 (Weber et al.), 5,438,290 (Tanaka), 5,642,018 (Marcotte), 5,670,974 (Ohba et al.), 5,808,420 (Rilly et al.), and 5,828,353 (Kishi et al.), all incorporated herein by reference.

Slow Ramp Reset

Slow rise slopes or ramps may be used in the practice of this invention. The prior art discloses slow rise slopes or ramps for the addressing of AC plasma displays. The early patents include U.S. Pat. Nos. 4,063,131 and 4,087,805 issued to John Miller of Owens-Illinois; U.S. Pat. No. 4,087,807 issued to Joseph Miavecz of Owens-Illinois; and U.S. Pat. Nos. 4,611,203 and 4,683,470 issued to Tony Criscimagna et al. of IBM, all incorporated herein by reference.

Architecture for a slow ramp reset voltage is disclosed in U.S. Pat. No. 5,745,086 issued to Larry F. Weber of Plasmaco and Matsushita, incorporated herein by reference. Weber ('086 ) discloses positive or negative ramp voltages that exhibit a slope that is set to assure that current flow through each display pixel site remains in a positive resistance region of the gas discharge. The slow ramp architecture may be used in combination with ADS as disclosed in FIG. 11 of Weber ('086). PCT Patent Application WO 00/30065 and U.S. Pat. No. 6,738,033, both filed by Junichi Hibino et al. of Matsushita also disclose architecture for a slow ramp reset voltage and are incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Development of New Driving Method for AC-PDPs by Tokunaga et al. of Pioneer. *Proceedings of the Sixth International Display Workshops*, IDW 99, pages 787-790, Dec. 1-3, 1999, Sendai, Japan. Also see European Patent Applications EP 1 020 838 A1 by Tokunaga et al. of Pioneer. The CLEAR techniques disclosed in the above Pioneer IDW publication and Pioneer EP 1020838, are incorporated herein by reference.

In the practice of this invention, it is contemplated that the ADS architecture may be combined with a CLEAR or like technique as required for the reduction of motion and visual artifacts. CLEAR and ADS may also be used with the slope ramp address.

SAS

In one embodiment of this invention it is contemplated using SAS electronic architecture to address a PDP panel constructed of Plasma-shells. SAS architecture comprises addressing one display section of a surface discharge PDP while another section of the PDP is being simultaneously sustained. This architecture is called Simultaneous Address and Sustain (SAS). See U.S. Patent Application Publication 2001/0038366, incorporated herein by reference.

SAS offers a unique electronic architecture which is different from prior art columnar discharge and surface discharge electronics architectures including ADS, AWD, and MASS. It offers important advantages as discussed herein.

In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y.

In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields.

Addressing is the selective application of data to individual pixels. It includes the writing or erasing of individual pixels.

Reset is a voltage pulse which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with another embodiment of the SAS architecture, there is applied a slow rise time or slow ramp reset voltage as disclosed in U.S. Pat. No. 5,745,086 (Weber) cited above and incorporated herein by reference. As used herein "slow rise time or slow ramp voltage" is a bulk address commonly called a reset pulse with a positive or negative slope so as to provide a uniform wall charge at all pixels in the PDP.

The slower the rise time of the reset ramp, the less visible the light or background glow from those off-pixels (not in the on-state) during the slow ramp bulk address.

Less background glow is particularly desirable for increasing the contrast ratio which is inversely proportional to the light-output from the off pixels during the reset pulse. Those off-pixels which are not in the on-state will give a background glow during the reset. The slower the ramp, the less light output with a resulting higher contrast ratio. Typically the "slow ramp reset voltages" disclosed in the prior art have a slope of about 3.5 volts per microsecond with a range of about 2 to about 9 volts per microsecond. In the SAS architecture, it is possible to use "slow ramp reset voltages" below 2 volts per microsecond, for example about 1 to 1.5 volts per microsecond without decreasing the number of PDP rows, without decreasing the number of sustain pulses or without decreasing the number of subfields.

Positive Column Gas Discharge

In one embodiment of this invention, the PDP is operated with positive column discharge. The use of Plasma-shells alone or in combination with Plasma-tubes allow the PDP to be operated with positive column gas discharge, for example as disclosed by Weber, Rutherford, and other prior art cited hereinafter and incorporated herein by reference. The discharge length inside the Plasma-shell and/or Plasma-tube must be sufficient to accommodate the length of the positive column gas discharge, generally up to about 1400 micrometers. The Plasma-shells and/or Plasma-tubes may be of any geometric shape and of any predetermined length, typically at least about 1400 micrometers to accommodate positive column discharge. A Plasma-tube differs from a Plasma-shell by containing multiple gas discharge cells or pixels. The following prior art references relate to positive column discharge and are incorporated herein by reference.

U.S. Pat. No. 6,184,848 (Weber) discloses the generation of a "positive column" plasma discharge wherein the plasma discharge evidences a balance of positively charged ions and electrons. The PDP discharge operates using the same fundamental principle as a fluorescent lamp, i.e., a PDP employs ultraviolet light generated by a gas discharge to excite visible light emitting phosphors. Weber discloses an inactive isolation bar.

*PDP With Improved Drive Performance at Reduced Cost* by James Rutherford, Huntertown, Ind., *Proceedings of the Ninth International Display Workshops*, Hiroshima, Japan, pages 837 to 840, Dec. 4-6, 2002, discloses an electrode structure and electronics for a "positive column" plasma display. Rutherford discloses the use of the isolation bar as an active electrode.

Additional positive column gas discharge prior art incorporated herein by reference includes:

*Positive Column AC Plasma Display*, Larry F. Weber, 23rd International Display Research Conference (IDRC 03), September 16-18, *Conference Proceedings*, pages 119-124, Phoenix Ariz.

*Dielectric Properties and Efficiency of Positive Column AC* PDP, Nagormy et al., 23rd International Display Research Conference (IDRC 03), Sep. 16-18, 2003, *Conference Proceedings*, P-45, pages 300-303, Phoenix, Ariz.

*Simulations of AC PDP Positive Column and Cathode Fall Efficiencies*, Drallos et al., 23rd International Display Research Conference (IDRC 03), Sep. 16-18, 2003, *Conference Proceedings*, P-48, pages 304-306, Phoenix, Ariz.

U.S. Pat. No. 6,376,995 (Kato et al.)

U.S. Pat. No. 6,528,952 Kato et al.)

U.S. Pat. No. 6,693,389 (Marcotte et al.)

U.S. Pat. No. 6,768,478 (Wani et al.)

U.S. Patent Application Publication 2003/0102812 (Marcotte et al.)

Radio Frequency

The Plasma-shells may be operated with radio frequency (RF). The RF may especially be used to sustain the plasma discharge. RF may also be used to operate the Plasma-shells with a positive column discharge. The use of RF in a PDP is disclosed in the following prior art, all incorporated herein by reference.

U.S. Pat. No. 6,271,810 Yoo et al.

U.S. Pat. No. 6,340,866 Yoo

U.S. Pat. No. 6,473,061 Lim et al.

U.S. Pat. No. 6,476,562 Yoo et al.

U.S. Pat. No. 6,483,489 Yoo et al.

U.S. Pat. No. 6,501,447 Kang et al.

U.S. Pat. No. 6,605,897 Yoo

U.S. Pat. No. 6,624,799 Kang et al.

U.S. Pat. No. 6,661,394 Choi

U.S. Pat. No. 6,794,820 Kang et al.

Shell Materials

The Plasma-shell may be constructed of any suitable material such as glass or plastic as disclosed in the prior art. In the practice of this invention, it is contemplated that the Plasma-shell may be made of any suitable inorganic compounds of metals and/or metalloids, including mixtures or combinations thereof. Contemplated inorganic compounds include the oxides, carbides, nitrides, nitrates, silicates, aluminates, phosphates, and/or borates.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment of this invention, the Plasma-shell is made of fused particles of glass, ceramic, glass ceramic, refractory, fused silica, quartz, or like amorphous and/or crystalline materials including mixtures of such.

In one preferred embodiment, a ceramic material is selected based on its transmissivity to light after firing. This may include selecting ceramics material with various optical cutoff frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the Plasma-shell to produce various colors. The application of the phosphor to the exterior of the Plasma-shell may be done by any suitable means before or after the Plasma-shell is positioned in the PDP, i.e., on a flexible or rigid substrate. There may be applied several layers or coatings of phosphors, each of a different composition.

In one specific embodiment of this invention, the Plasma-shell is made of an aluminate silicate or contains a layer of aluminate silicate. When the ionizable gas mixture contains helium, the aluminate silicate is especially beneficial in preventing the escaping of helium.

It is also contemplated that the Plasma-shell may be made of lead silicates, lead phosphates, lead oxides, borosilicates, alkali silicates, aluminum oxides, and pure vitreous silica.

For secondary electron emission, the Plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The Plasma-shell may also contain or be partially or wholly constructed of luminescent materials such as inorganic phosphor(s). The phosphor may be a continuous or discontinuous layer or coating on the interior or exterior of the shell. Phosphor particles may also be introduced inside the Plasma-shell or embedded within the shell. Luminescent quantum dots may also be incorporated into the shell.

Secondary Electron Emission

The use of secondary electron emission (Townsend coefficient) materials in a plasma display is well known in the prior art and is disclosed in U.S. Pat. No. 3,716,742 issued to Nakayama et al. The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807, 4,126,809, and 4,494,038, all issued to Wedding et al., and incorporated herein by reference. Lead oxide may also be used as a secondary electron material. Mixtures of secondary electron emission materials may be used.

In one embodiment and mode contemplated for the practice of this invention, the secondary electron emission material is magnesium oxide on part or all of the internal surface of a Plasma-shell. The secondary electron emission material may also be on the external surface. The thickness of the magnesium oxide may range from about 250 Angstrom Units (Å) to about 10,000 Angstrom Units (Å).

The entire Plasma-shell may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the Plasma-shell.

Magnesium oxide increases the ionization level through secondary electron emission that in turn leads to reduced gas discharge voltages. In one embodiment, the magnesium oxide is on the inner surface of the Plasma-shell and the phosphor is located on external surface of the Plasma-shell.

Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a Plasma-shell minimizes exposure of the magnesium oxide to contamination.

The magnesium oxide may be applied to the inside of the Plasma-shell by incorporating magnesium vapor as part of the ionizable gases introduced into the Plasma-shell while the microsphere is at an elevated temperature. The magnesium may be oxidized while at an elevated temperature.

In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow Plasma-shell as used in the practice of this invention contain(s) one or more ionizable gas components. In the practice of this invention, the gas is selected to emit photons in the visible, IR, and/or UV spectrum.

The UV spectrum is divided into regions. The near UV region is a spectrum ranging from about 340 to 450 nm (nanometers). The mid or deep UV region is a spectrum ranging from about 225 to 325 nm. The vacuum UV region is a spectrum ranging from about 100 to 200 nm. The PDP prior art has used vacuum UV to excite photoluminescent phosphors. In the practice of this invention, it is contemplated using a gas which provides UV over the entire spectrum ranging from about 100 to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 225 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof.

Isotopes of the above and other gases are contemplated. These include isotopes of helium such as helium 3, isotopes of hydrogen such as deuterium (heavy hydrogen), tritium ($T^3$) and DT, isotopes of the rare gases such as xenon-129, isotopes of oxygen such as oxygen-18. Other isotopes include deuterated gases such as deuterated ammonia ($ND_3$) and deuterated silane ($SiD_4$).

In one embodiment, a two-component gas mixture (or composition) is used such as a mixture of argon and xenon, argon and helium, xenon and helium, neon and argon, neon and xenon, neon and helium, and neon and krypton.

Specific two-component gas mixtures (compositions) include about 5% to 90% atoms of argon with the balance xenon.

Another two-component gas mixture is a mother gas of neon containing 0.05 to 15% atoms of xenon, argon, or krypton. This can also be a three-component, four-component gas, or five-component gas by using small quantities of an additional gas or gases selected from xenon, argon, krypton, and/or helium.

In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon.

U.S. Pat. No. 4,081,712 (Bode et al.), incorporated herein by reference, discloses the addition of helium to a gaseous medium of 90 to 99.99% atoms of neon and 10 to 0.01% atoms of argon, xenon, and/or krypton.

In one embodiment there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference.

Pure neon may be used and the Plasma-shells operated without memory margin using the architecture disclosed by U.S. Pat. No. 3,958,151 (Yano) discussed above and incorporated herein by reference.

Excimers

Excimer gases may also be used as disclosed in U.S. Pat. Nos. 4,549,109 and 4,703,229 issued to Nighan et al., both incorporated herein by reference. Nighan et al. ('109) and ('229) disclose the use of excimer gases formed by the combination of halogens with rare gases. The halogens include fluorine, chlorine, bromine, and iodine. The rare gases include helium, xenon, argon, neon, krypton, and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. Such other applications include gas-sensing devices for detecting radiation and radar transmissions. Such other gases include $C_2H_2$—$CF_4$—Ar mixtures as disclosed in U.S. Pat. Nos. 4,201,692 and 4,309,307 (Christophorou et al.), both incorporated herein by reference. Also contemplated are gases disclosed in U.S. Pat. No. 4,553,062 (Ballon et al.), incorporated herein by reference. Other gases include sulfur hexafluoride, HF, $H_2S$, $SO_2$, SO, $H_2O_2$, and so forth.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure.

In the practice of this invention, the gas pressure inside of the hollow Plasma-shell may be equal to or less than atmospheric pressure or may be equal to or greater than atmospheric pressure. The typical sub-atmospheric pressure is about 150 to 760 Torr. However, pressures above atmospheric may be used depending upon the structural integrity of the Plasma-shell.

In one embodiment of this invention, the gas pressure inside of the Plasma-shell is equal to or less than atmospheric, about 150 to 760 Torr, typically about 350 to about 650 Torr.

In another embodiment of this invention, the gas pressure inside of the Plasma-shell is equal to or greater than atmospheric. Depending upon the structural strength of the Plasma-shell, the pressure above atmospheric may be about 1 to 250 atmospheres (760 to 190,000 Torr) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture.

The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over 1 million plasma display panels per year.

The gas filled Plasma-shells used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, the Plasma-shells are located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all cited above and incorporated herein by reference. The Plasma-shells may be positioned on the surface of the substrate and/or positioned in substrate openings such as in channels, trenches, grooves, holes, wells, cavities, hollows, and so forth. These channels, trenches, grooves, holes, wells, cavities, hollows, etc., may extend through the substrate so that the Plasma-shells positioned therein may be viewed from either side of the substrate.

The Plasma-shells may also be positioned on or in a substrate within a dual substrate plasma display structure. Each Plasma-shell is placed inside of a gas discharge (plasma) display device, for example, on the substrate along the channels, trenches, grooves, etc. between the barrier walls of a plasma display barrier structure such as disclosed in U.S. Pat. Nos. 5,661,500 (Shinoda et al.), 5,674,553 (Shinoda et al.), and 5,793,158 (Wedding), cited above and incorporated herein by reference. The Plasma-shells may also be positioned within a cavity, well, hollow, concavity, or saddle of a plasma display substrate, for example as disclosed by U.S. Pat. No. 4,827,186 (Knauer et al.), incorporated herein by reference.

In a device as disclosed by Wedding ('158) or Shinoda et al. ('500), the Plasma-shells may be conveniently added to the substrate cavities and the space between opposing electrodes before the device is sealed. An aperture and tube can be used for bake out if needed of the space between the two opposing substrates, but the costly gas fill operation is eliminated.

In one embodiment, the Plasma-shells are conveniently added to the gas discharge space between opposing electrodes before the device is sealed. The presence of the Plasma-shells inside of the display device add structural support and integrity to the device. The present color AC plasma displays of 40 to 50 inches are fragile and are subject to breakage during shipment and handling.

The Plasma-shells may be sprayed, stamped, pressed, poured, screen-printed, or otherwise applied to the substrate. The substrate surface may contain an adhesive or sticky surface to bind the Plasma-shell to the substrate.

The practice of this invention is not limited to a flat surface display. The Plasma-shell may be positioned or located on a conformal surface or substrate so as to conform to a predetermined shape such as a curved or irregular surface.

In one embodiment of this invention, each Plasma-shell is positioned within a hole, well, cavity, etc. on a single-substrate or monolithic gas discharge structure that has a flexible or bendable substrate. In another embodiment, the substrate is rigid. The substrate may also be partially or semi-flexible.

Substrate

In accordance with various embodiments of this invention, the PDP may be comprised of a single substrate or dual substrate device with flexible, semi-flexible, or rigid substrates. The substrate may be opaque, transparent, translucent, or non-light transmitting. In some embodiments, there may be used multiple substrates of three or more. Substrates may be flexible films, such as a polymeric film substrate. The flexible substrate may also be made of metallic materials alone or incorporated into a polymeric substrate. Alternatively or in addition, one or both substrates may be made of an optically-transparent thermoplastic polymeric material. Examples of suitable such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication 2004/0179145 (Jacobsen et al.), incorporated herein by reference.

Alternatively, one or both of the substrates may be made of a rigid material. For example, one or both of the substrates may be a glass substrate. The glass may be a conventionallyavailable glass, for example having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm.

Further details regarding substrates and substrate materials may be found in International Publications Nos. WO 00/46854, WO 00/49421, WO 00/49658, WO 00/55915, and WO 00/55916, the entire disclosures of which are incorporated herein by reference. Apparatus, methods, and compositions for producing flexible substrates are disclosed in U.S. Pat. Nos. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Positioning of Plasma-Shell on Substrate

The Plasma-shell may be positioned or located on the substrate by any appropriate means. In one embodiment of this invention, the Plasma-shell is bonded to the surface of a monolithic or dual-substrate display such as a PDP. The Plasma-shell is bonded to the substrate surface with a non-conductive, adhesive material which also serves as an insulating barrier to prevent electrically shorting of the conductors or electrodes connected to the Plasma-shell.

The Plasma-shell may be mounted or positioned within a substrate opening such as a hole, well, cavity, hollow, or like depression. The hole, well, cavity, hollow or depression is of suitable dimensions with a mean or average diameter and depth for receiving and retaining the Plasma-shell. As used herein hole includes well, cavity, hollow, depression, or any similar configuration that accepts the Plasma-shell. In U.S. Pat. No. 4,827,186 (Knauer et al.), there is shown a cavity referred to as a concavity or saddle. The depression, well or cavity may extend partly through the substrate, embedded within or extend entirely through the substrate. The cavity may comprise an elongated channel, trench, or groove extending partially or completely across the substrate.

The electrodes must be in direct contact with each Plasma-shell. An air gap between an electrode and the Plasma-shell will cause high operating voltages. As disclosed herein, an electrically conductive adhesive and/or an electrically conductive filler is used to bridge or connect each electrode to the Plasma-shell. Such conductive material must be carefully applied so as to not electrically short the electrode to other nearby electrodes.

As disclosed herein, a clearance space is provided to prevent the flow and shorting of the electrically conductive substance. An insulating dielectric material may also be applied to fill any air gap. The dielectric material may also be an insulating barrier between Plasma-shells. The insulating dielectric may comprise any suitable non-conductive material and may also be an adhesive to bond the Plasma-shell to the substrate.

In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Light Barriers

Light barriers of opaque, translucent, or non-transparent material may be located between Plasma-shells to prevent optical cross-talk between Plasma-shells, particularly between adjacent Plasma-shells. A black material such as carbon filler is typically used.

Electrically Conductive Bonding Substance

In the practice of this invention, the conductors or electrodes are electrically connected to each Plasma-shell with an electrically conductive bonding substance.

The electrically conductive bonding substance can be any suitable inorganic or organic material including compounds, mixtures, dispersions, pastes, liquids, cements, and adhesives.

In one embodiment, the electrically-conductive bonding substance is an organic substance with conductive filler material.

Contemplated organic substances include adhesive monomers, dimers, trimers, polymers and copolymers of materials such as polyurethanes, polysulfides, silicones, and epoxies. A wide range of other organic or polymeric materials may be used.

Contemplated conductive filler materials include conductive metals or metalloids such as silver, gold, platinum, copper, chromium, nickel, aluminum, and carbon.

The conductive filler may be of any suitable size and form such as particles, powder, agglomerates, or flakes of any suitable size and shape. It is contemplated that the particles, powder, agglomerates, or flakes may comprise a non-metal, metal, or metalloid core with an outer layer, coating, or film of conductive metal.

Some specific embodiments of conductive filler materials include silver-plated copper beads, silver-plated glass beads, silver particles, silver flakes, gold-plated copper beads, gold-plated glass beads, gold particles, gold flakes, and so forth.

In one particular embodiment of this invention there is used an epoxy filled with 60% to 80% by weight silver.

Examples of electrically conductive bonding substances are well known in the art. The disclosures including the compositions of the following references are incorporated herein by reference.

U.S. Pat. No. 3,412,043 (Gilliland) discloses an electrically conductive composition of silver flakes and resinous binder.

U.S. Pat. No. 3,983,075 (Marshall et al.) discloses a copper filled electrically conductive epoxy.

U.S. Pat. No. 4,247,594 (Shea et al.) discloses an electrically conductive resinous composition of copper flakes in a resinous binder.

U.S. Pat. Nos. 4,552,607 and 4,670,339 (Frey) disclose a method of forming an electrically conductive bond using copper microspheres in an epoxy.

U.S. Pat. No. 4,880,570 (Sanborn et al.) discloses an electrically conductive epoxy-based adhesive selected from the amine curing modified epoxy family with a filler of silver flakes.

U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed.

U.S. Pat. No. 5,298,194 (Carter et al.) discloses an electrically conductive adhesive composition comprising a polymer or copolymer of polyolefins or polyesters filled with silver particles.

U.S. Pat. No. 5,575,956 (Hermansen et al.) discloses electrically-conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed.

U.S. Pat. No. 5,891,367 (Basheer et al.) discloses a conductive epoxy adhesive comprising an epoxy resin cured or reacted with selected primary amines and filled with silver flakes. The primary amines provide improved impact resistance.

U.S. Pat. No. 5,918,364 (Kulesza et al.) discloses substrate bumps or pads formed of electrically conductive polymers filled with gold or silver.

U.S. Pat. No. 6,184,280 (Shibuta) discloses an organic polymer containing hollow carbon microfibers and an electrically conductive metal oxide powder.

In another embodiment, the electrically-conductive bonding substance is an organic substance without a conductive filler material.

Examples of electrically-conductive bonding substances are well known in the art. The disclosures including the compositions of the following references are incorporated herein by reference.

U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers.

Electrically conductive polymer compositions are also disclosed in U.S. Pat. Nos. 5,917,693 (Kono et al.), 6,096,825 (Garnier), and 6,358,438 (Isozaki et al.).

The electrically conductive polymers disclosed above may also be used with conductive fillers.

In some embodiments, organic ionic materials such as calcium stearate may be added to increase electrical conductivity. See U.S. Pat. No. 6,599,446 (Todt et al.), incorporated herein by reference.

In one embodiment hereof, the electrically conductive bonding substance is luminescent, for example as disclosed in U.S. Pat. No. 6,558,576 (Brielmann et al.), incorporated herein by reference.

EMI/RFI Shielding

In some embodiments, electroductive bonding substances may be used for EMI (electromagnetic interference) and/or RFI (radio-frequency interference) shielding. Examples of such EMI/RFI shielding are disclosed in U.S. Pat. Nos. 5,087,314 (Sandborn et al.) and 5,700,398 (Angelopoulos et al.), both incorporated herein by reference.

Electrodes

One or more hollow Plasma-shells containing the ionizable gas are located within the display panel structure, each Plasma-shell being in contact with at least two electrodes. In accordance with this invention, the contact is made by an electrically conductive bonding substance applied to each shell so as to form an electrically conductive pad for connection to the electrodes. A dielectric barrier substance may also be used in lieu of or in addition to the conductive substance. Each electrode pad may partially cover the outside shell surface of the Plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. Nos. 3,603,836 (Grier) and 3,701,184 (Grier), incorporated herein by reference. Apertured electrodes may be used as disclosed in U.S. Pat. Nos. 6,118,214 and 5,411,035 (Marcotte) and U.S. Patent Application Publication 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the Plasma-shell.

The electrode array may be divided into two portions and driven from both sides with a dual scan architecture as disclosed by Dr. Thomas J. Pavliscak in U.S. Pat. Nos. 4,233,623 and 4,320,418, both incorporated herein by reference.

A flat Plasma-shell surface is particularly suitable for connecting electrodes to the Plasma-sphere. If one or more electrodes connect to the bottom of Plasma-shell, a flat bottom surface is desirable. Likewise, if one or more electrodes connect to the top or sides of the Plasma-shell, it is desirable for the connecting surface of such top or sides to be flat.

The electrodes may be applied to the substrate or to the Plasma-shells by thin film methods such as vapor phase deposition, e-beam evaporation, sputtering, conductive doping, etc. or by thick film methods such as screen printing, ink jet printing, etc.

In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow Plasma-shell containing ionizable gas is positioned in the gas discharge (plasma) display device at the intersection of at least two opposing electrodes. When an appropriate voltage potential is applied to an opposing pair of electrodes, the ionizable gas inside of the Plasma-shell at the crossover is energized and a gas discharge occurs. Photons of light in the visible and/or invisible range are emitted by the gas discharge. These may be used to excite a luminescent material located inside or outside the shell of the Plasma-shell.

Shell Geometry

The shell of the Plasma-shells may be of any suitable volumetric shape or geometric configuration to encapsulate the ionizable gas independently of the PDP or PDP substrate. The volumetric and geometric shapes of the Plasma-shell include but are not limited to disc, dome, spherical, oblate, spheroid, prolate spheroid, capsular, elliptical, ovoid, egg shape, bullet shape, pear and/or tear drop. In an oblate spheroid, the diameter at the polar axis is flattened and is less than the diameter at the equator. In a prolate spheroid, the diameter at the equator is less than the diameter at the polar axis such that the overall shape is elongated. Likewise, the shell cross-section along any axis may be of any suitable geometric design including circular, elliptical, polygonal, and so forth.

The diameter of the Plasma-shells used in the practice of this invention may vary over a wide range. In a gas discharge display, the average diameter of a Plasma-shell is about 1 mil to 20 mils (where one mil equals 0.001 inch) or about 25 microns to 500 microns where 25.4 microns (micrometers) equals 1 mil or 0.001 inch. Plasma-shells can be manufactured up to 80 mils or about 2000 microns in diameter or greater. The thickness of the wall of each hollow Plasma-shell must be sufficient to retain the gas inside, but thin enough to allow passage of photons emitted by the gas discharge. The wall thickness of the Plasma-shell should be kept as thin as practical to minimize photon absorption, but thick enough to retain sufficient strength so that the Plasma-shells can be easily handled and pressurized. Typically the Plasma-shell shell thickness is about 1% to 20% of the external width or diameter of the tube shell.

The average diameter of the Plasma-shells may be varied for different phosphors to achieve color balance. Thus for a gas discharge display having phosphors which emit red, green, and blue light in the visible range, the Plasma-shells for the red phosphor may have an average diameter less than the average diameter of the Plasma-shells for the green or blue phosphor. Typically the average diameter of the red phosphor Plasma-shells is about 80% to 95% of the average diameter of the green phosphor Plasma-shells.

The average diameter of the blue phosphor Plasma-shells may be greater than the average diameter of the red or green phosphor Plasma-shells. Typically the average Plasma-shell diameter for the blue phosphor is about 105% to 125% of the average Plasma-shell diameter for the green phosphor and about 110% to 155% of the average diameter of the red phosphor.

In another embodiment using a high brightness green phosphor, the red and green Plasma-shell may be reversed such that the average diameter of the green phosphor Plasma-shell is about 80% to 95% of the average diameter of the red phosphor Plasma-shell. In this embodiment, the average diameter of the blue Plasma-shell is 105% to 125% of the average Plasma-shell diameter for the red phosphor and about 110% to 155% of the average diameter of the green phosphor.

The red, green, and blue Plasma-shells may also have different size diameters so as to enlarge voltage margin and improve luminance uniformity as disclosed in U.S. Patent Application Publication 2002/0041157 A1 (Heo), incorporated herein by reference. The widths of the corresponding electrodes for each RBG Plasma-shell may be of different dimensions such that an electrode is wider or more narrow for a selected phosphor as disclosed in U.S. Pat. No. 6,034,657 (Tokunaga et al.), incorporated herein by reference. There also may be used combinations of different geometric shapes for different colors. Thus there may be used a square cross section Plasma-shell for one color, a circular cross-section for another color, and another geometric cross section such as triangular for a third color. A combination of Plasma-shells of different geometric shapes may be used such as Plasma-sphere and Plasma-disc, Plasma-sphere and Plasma-dome, Plasma disc and Plasma-dome, or Plasma-sphere, Plasma-disc, and Plasma-dome. Multiple Plasma-shells of one color may be used such as two or more consecutive Plasma-shells of blue, red, or green.

Organic Luminescent Substance

Organic and/or inorganic luminescent substances may be used in the practice of this invention. The organic luminescent substance may be used alone or in combination with an inorganic luminescent substance.

In accordance with one embodiment of this invention, an organic luminescent substance is located in close proximity to the enclosed gas discharge within a Plasma-shell, so as to be excited by photons from the enclosed gas discharge.

In accordance with one preferred embodiment of this invention, an organic photoluminescent substance is positioned on at least a portion of the external surface of a Plasma-shell, so as to be excited by photons from the gas discharge within the Plasma-shell, such that the excited photoluminescent substance emits visible and/or invisible light.

As used herein organic luminescent substance comprises one or more organic compounds, monomers, dimers, trimers, polymers, copolymers, or like organic materials which emit visible and/or invisible light when excited by photons from the gas discharge inside of the Plasma-shell.

Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent material. All are collectively referred to herein as organic photoluminescent phosphor.

Organic photoluminescent phosphor substances contemplated herein include those organic light emitting diodes or devices (OLED) and organic electroluminescent (EL) materials which emit light when excited by photons from the gas discharge of a gas plasma discharge. OLED and organic EL substances include the small molecule organic EL and the large molecule or polymeric OLED.

Small molecule organic EL substances are disclosed in U.S. Pat. Nos. 4,720,432 (VanSlyke et al.), 4,769,292 (Tang et al.), 5,151,629 (VanSlyke), 5,409,783 (Tang et al.), 5,645,948 (Shi et al.), 5,683,823 (Shi et al.), 5,755,999 (Shi et al.), 5,908,581 (Chen et al), 5,935,720 (Chen et al.), 6,020,078 (Chen et al.), and 6,069,442 (Hung et al.), 6,348,359 (VanSlyke), and 6,720,090 (Young et al.), all incorporated herein by reference. The small molecule organic light emitting devices may be called SMOLED.

Large molecule or polymeric OLED substances are disclosed in U.S. Pat. Nos. 5,247,190 (Friend et al.), 5,399,502 (Friend et al.), 5,540,999 (Yamamoto et al.), 5,900,327 (Pei et al.), 5,804,836 (Heegar et al.), 5,807,627 (Friend et al.), 6,361,885 (Chou), and 6,670,645 (Grushin et al.), all incorporated herein by references. The polymer light emitting devices may be called PLED.

Organic luminescent substances also include OLEDs doped with phosphorescent compounds as disclosed in U.S. Pat. No. 6,303,238 (Thompson et al.), incorporated herein by reference.

Organic photoluminescent substances are also disclosed in U.S. Patent Application Publication 2002/0101151 (Choi et al.), U.S. 2002/0063525 (Choi et al.), U.S. 2003/0003225 (Choi et al.) and U.S. 2003/0052596 (Yi et al.); U.S. Pat. Nos. 6,610,554 (Yi et al.), and 6,692,326 (Choi et al.); and International Publications WO 02/104077 and WO 03/046649, all incorporated herein by reference.

In one preferred embodiment of this invention, the organic luminescent phosphorous substance is a color-conversion-media (CCM) that converts light (photons) emitted by the gas discharge to visible or invisible light. Examples of CCM substances include the fluorescent organic dye compounds.

In one preferred embodiment, the organic luminescent substance is selected from a condensed or fused ring system such as a perylene compound, a perylene based compound, a perylene derivative, a perylene based monomer, dimer or trimer, a perylene based polymer or coploymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials which may be used as photoluminescent phosphorous substances.

U.S. Pat. No. 5,693,808 (Langhalas), incorporated herein by reference, discloses the preparation of luminescent perylene dyes.

U.S. Patent Application Publication 2004/0009367 (Hatwar), incorporated herein by reference, discloses the preparation of luminescent materials doped with fluorescent perylene dyes.

U.S. Pat. No. 6,528,188 (Suzuki et al.), incorporated herein by reference, discloses the preparation and use of luminescent perylene compounds.

These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation.

A material with conjugation or extended conjugation absorbs light and then transmits the light to the various conjugated bonds. Typically the number of conjugate-double bonds ranges from about 4 to about 15.

Further examples of conjugate-bonded or condensed/fused benzene rings are disclosed in U.S. Pat. Nos. 6,614,175 (Aziz et al.) and U.S. Pat. No. 6,479,172 (Hu et al.), both incorporated herein by reference. U.S. Patent Application Publication 2004/0023010 (Bulovic et al.) discloses luminescent nanocrystals with organic polymers including conjugated organic polymers.

Cumulene is conjugated only with carbon and hydrogen atoms. Cumulene becomes more deeply colored as the conjugation is extended.

Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference.

The organic luminescent substance may be an organic lumophore, for example as disclosed in U.S. Pat. Nos. 5,354,825 (Klainer et al.), 5,480,723 (Klainer et al.), 5,700,897 (Klainer et al.), and 6,538,263 (Park et al.), all incorporated herein by reference. Also lumophores are disclosed in S. E. Shaheen et al., *Journal of Applied Physics*, Vol 84, Number 4, pages 2324 to 2327, Aug. 15, 1998; J. D. Anderson et al., *Journal American Chemical Society* 1998, Vol 120, pages 9646 to 9655; and Gyu Hyun Lee et al., Bulletin of Korean Chemical Society, 2002, Vol 23, NO. 3, pages 528 to 530, all incorporated herein by reference.

The organic luminescent substance may be applied by any suitable method to the external surface of the Plasma-shell, to the substrate or to any location in close proximity to the gas discharge contained within the Plasma-shell.

Such methods include thin film deposition methods such as vapor phase deposition, sputtering and E-beam evaporation. Also thick film or application methods may be used such as screen-printing, ink jet printing, and/or slurry techniques.

Small size molecule OLED materials are typically deposited upon the external surface of the Plasma-shell by thin film deposition methods such as vapor phase deposition or sputtering.

Large size molecule or polymeric OLED materials are deposited by so called thick film or application methods such as screen-printing, ink jet, and/or slurry techniques.

If the organic luminescent substance such as a photoluminescent phosphor is applied to the external surface of the Plasma-shell, it may be applied as a continuous or discontinuous layer or coating such that the Plasma-shell is completely or partially covered with the luminescent substance.

Inorganic Luminescent Substances

Inorganic luminescent substances may be used alone or in combination with organic luminescent substances.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb.

In one mode and embodiment of this invention using a green light-emitting phosphor, there is used a green light-emitting phosphor selected from the zinc orthosilicate phosphors such as $ZnSiO_4:Mn^{2+}$. Green light emitting zinc orthosilicates including the method of preparation are disclosed in U.S. Pat. No. 5,985,176 (Rao) which is incorporated herein by reference. These phosphors have a broad emission in the green region when excited by 147 nm and 173 nm (nanometers) radiation from the discharge of a xenon gas mixture.

In another mode and embodiment of this invention there is used a green light-emitting phosphor which is a terbium activated yttrium gadolinium borate phosphor such as (Gd, Y) $BO_3:Tb^{3+}$. Green light-emitting borate phosphors including the method of preparation are disclosed in U.S. Pat. No. 6,004,481 (Rao) which is incorporated herein by reference.

In another mode and embodiment there is used a manganese activated alkaline earth aluminate green phosphor as disclosed in U.S. Pat. No. 6,423,248 (Rao), peaking at 516 nm when excited by 147 and 173 nm radiation from xenon. The particle size ranges from 0.05 to 5 microns. Rao ('248) is incorporated herein by reference.

Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated.

Green light-emitting terbium-activated lanthanum cerium orthophosphate phosphors are disclosed in U.S. Pat. No. 4,423,349 (Nakajima et al.) which is incorporated herein by reference. Green light-emitting lanthanum cerium terbium phosphate phosphors are disclosed in U.S. Pat. No. 5,651,920 which is incorporated herein by reference.

Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na.

In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors which emit blue visible light are disclosed in U.S. Pat. Nos. 5,611,959 Nos. (Kijima et al.) and 5,998,047 (Bechtel et al.), both incorporated herein by reference. The aluminate phosphors may also be selectively coated as disclosed by Bechtel et al. ('047).

Blue light-emitting phosphors may be selected from a number of divalent europium-activated aluminates such as disclosed in U.S. Pat. No. 6,096,243 (Oshio et al.) incorporated herein by reference.

The preparation of BAM phosphors for a PDP is also disclosed in U.S. Pat. No. 6,045,721 (Zachau et al.), incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao) which is incorporated herein by reference.

In a best mode and embodiment of this invention using a blue-emitting phosphor, a mixture or blend of blue emitting phosphors is used such as a blend or complex of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference.

Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S:Eu$ and $Y_2O_3S:Eu$.

In a best mode and embodiment of this invention using a red-emitting phosphor, there is used a red light-emitting phosphor which is an europium activated yttrium gadolinium borate phosphors such as $(Y,Gd)BO_3:Eu^{3+}$. The composition and preparation of these red-emitting borate phosphors is disclosed in U.S. Pat. No. 6,042,747 (Rao) and U.S. Pat. No. 6,284,155 (Rao), both incorporated herein by reference.

These europium activated yttrium, gadolinium borate phosphors emit an orange line at 593 nm and red emission lines at 611 and 627 nm when excited by 147 nm and 173 nm UV radiation from the discharge of a xenon gas mixture. For television (TV) applications, it is preferred to have only the red emission lines (611 nm and 627 nm). The orange line (593 nm) may be minimized or eliminated with an external optical filter.

A wide range of red-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter.

Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$.

White-emitting phosphors are disclosed in U.S. Pat. No. 6,200,496 (Park et al.) incorporated herein by reference.

Pink-emitting phosphors are disclosed in U.S. Pat. No. 6,200,497 (Park et al.) incorporated herein by reference. Phosphor material which emits yellow light include ZnS:Au.

Photon Exciting of Luminescent Substance

In one embodiment contemplated in the practice of this invention, a layer, coating, or particles of luminescent substance such as phosphor is located on the exterior wall of the Plasma-shell. The photons of light pass through the shell or wall(s) of the Plasma-shell and excite the organic and/or inorganic photoluminescent phosphor located outside of the Plasma-shell. The phosphor may be located on the side wall(s) of a slot, channel, barrier, groove, cavity, hole, well, hollow or like structure of the discharge space.

In one embodiment, the gas discharge within the slot, channel, barrier, groove, cavity, hole, well or hollow produces photons that excite the organic and/or inorganic phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye.

In prior art AC plasma display structures as disclosed in U.S. Pat. Nos. 5,793,158 (Wedding) and 5,661,500 (Shinoda), phosphor is located on the wall(s) or side(s) of the barriers that form the channel, groove, cavity, well, or hollow. Phosphor may also be located on the bottom of the channel, or groove as disclosed by Shinoda et al. (500) or in a bottom cavity, well, or hollow as disclosed by U.S. Pat. No. 4,827,186 (Knauer et al.). The Plasma-shells are positioned within the channel barrier, groove, cavity, well or hollow so as to be in close proximity to the phosphor.

Thus in one embodiment of this invention, Plasma-shells are positioned within the channels, barriers, grooves, cavities, wells, or hollows, such that photons from the gas discharge within the Plasma-shell cause the phosphor along the wall(s), side(s) or at the bottom of the channel, barrier, groove, cavity, well, or hollow, to emit light in the visible and/or invisible range.

In another embodiment of this invention, phosphor is located on the outside surface of each Plasma-shell. In this embodiment, the outside surface is at least partially covered with phosphor that emits light in the visible and/or invisible range when excited by photons from the gas discharge within the Plasma-shell.

In another embodiment, phosphor is dispersed and/or suspended within the ionizable gas inside each Plasma-shell. In such embodiment, the phosphor particles are sufficiently small such that most of the phosphor particles remain suspended within the gas and do not precipitate or otherwise substantially collect on the inside wall of the Plasma-shell.

The average diameter of the dispersed and/or suspended phosphor particles is less than about 5 microns, typically less than 0.1 microns. Larger particles can be used depending on the size of the Plasma-shell. The phosphor particles may be introduced by means of a fluidized bed.

The luminescent substance such as a photoluminescent phosphor may be located on all or part of the external surface of the Plasma-shells and/or on all or part of the internal surface of the Plasma-shells. The phosphor may comprise particles dispersed or floating within the gas.

In one preferred embodiment contemplated for the practice of this invention, an organic luminescent phosphor is located on the external surface of the Plasma-shell. The organic phosphor may be used in combination with an inorganic phosphor. In this embodiment, the organic luminescent substance is located on the external surface and is excited by ultraviolet (UV) photons from the gas discharge inside the Plasma-shell. The phosphor may be selected to emit light in the visible range such as red, blue, or green light. Phosphor(s) may be selected to emit light of other colors such as white, pink, or yellow. The phosphor(s) may also be selected to emit light in non-visible ranges of the spectrum. Optical filters may be selected and matched with different phosphors.

The phosphor(s) thickness is sufficient to absorb the UV, but thin enough to emit light with minimum attenuation. Typically the phosphor(s) thickness is about 2 to 40 microns, preferably about 5 to 15 microns.

Dispersed or floating particles within the gas are typically spherical or needle shaped having an average size of about 0.01 to 5 microns.

A UV photoluminescent phosphor is excited by UV in the range of 50 to 400 nanometers. The phosphor may have a protective layer or coating which is transmissive to the excitation UV and the emitted visible light. Such include organic films such as parylene or inorganic films such as aluminum oxide or silica. Protective coatings are disclosed and discussed below.

Because the ionizable gas is contained within a multiplicity of Plasma-shells, it is possible to provide a custom gas mixture or composition at a custom pressure in each Plasma-sphere for each phosphor.

In the prior art, it is necessary to select an ionizable gas mixture and a gas pressure that is optimum for all phosphors used in the device such as red, blue, and green phosphors. However, this requires trade-offs because a particular gas mixture may be optimum for a selected green phosphor, but less desirable for selected red or blue phosphors. In addition, trade-offs are required for the gas pressure.

In the practice of this invention, an optimum gas mixture and an optimum gas pressure may be provided for each of the selected phosphors. Thus the gas mixture and gas pressure inside the Plasma-shells may be optimized with a custom gas mixture and a custom gas pressure, each or both optimized for each phosphor emitting red, blue, green, white, pink, or yellow light in the visible range or light in the invisible range. The diameter and the wall thickness of the Plasma-shell may also be adjusted and optimized for each phosphor. Depending upon the Paschen Curve (pd v. voltage) for the particular ionizable gas mixture, the operating voltage may be decreased by optimized changes in the gas mixture, gas pressure, and the diameter of the Plasma-shell.

Up-conversion

In another embodiment of this invention it is contemplated using an organic and/or inorganic luminescent substance such as a phosphor to convert infrared radiation to visible light. This is referred to in the literature as an up-conversion phosphor. The up-conversion phosphor is typically used in combination with a phosphor which converts UV radiation to visible light. An up-conversion phosphor in combination with such a UV phosphor is disclosed in U.S. Pat. No. 6,265,825 (Asano), incorporated herein by reference. Up-conversion may also be obtained with shell compositions such as thulium doped silicate glass compositions disclosed in U.S. Patent Application Publication 2004/0037538 (Schardt et al.), incorporated herein by reference.

Quantum Dots

In one embodiment of this invention, the organic and/or inorganic luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference.

Luminescent quantum dots are also disclosed in U.S. Pat. No. 6,468,808 (Nie et al.), U.S. Pat. No. 6,501,091 (Bawendi et al.), U.S. Pat. No. 6,698,313 (Park et al.), and U.S. Patent Application Publication 2003/0042850 (Bertram et al.), all incorporated herein by reference. The quantum dots may be added or incorporated into the shell during shell formation or after the shell is formed.

Protective Overcoat

In a preferred embodiment, the luminescent substance is located on the external viewing surface of the Plasma-shell. Organic luminescent phosphors are particularly suitable for placing on the exterior shell surface alone or combined with inorganic luminescent substances. The luminescent substance may have an inorganic and/or organic protective coating.

The protective coating for the luminescent substance may comprise a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen print, ink jet, or other convenient methods so as to form a clear film or coating of the acrylic compound over the luminescent substance.

Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment.

In one embodiment hereof the luminescent substance is coated with a film or layer of a parylene compound including monomers, dimers, trimers, polymers, copolymers, and derivatives thereof. The parylene compounds are widely used as protective films. Specific compounds including polymonochloro-para-xylyene (Parylene C) and poly-para-xylylene (Parylene N).

Parylene polymer films are also disclosed in U.S. Pat. Nos. 5,879,808 (Wary et al.) and 6,586,048 (Welch et al.), both incorporated herein by reference. The parylene compounds may be applied by ink jet printing, screen printing, spraying, and so forth as disclosed in U.S. Patent Application Publication 2004/0032466 (Deguchi et al.), incorporated herein by reference. Parylene conformal coatings are covered by Mil-I-46058C and ISO 9002.

Parylene films may also be induced into fluorescence by an active plasma as disclosed in U.S. Pat. No. 5,139,813 (Yira et al.), incorporated herein by reference.

Phosphor overcoats are also disclosed in U.S. Pat. Nos. 4,048,533 (Hinson et al.), 4,315,192 (Skwirut et al.), 5,592,052 (Maya et al.), 5,604,396 (Watanabe et al.), 5,793,158 (Wedding), and 6,099,753 (Yoshimura et al.), all incorporated herein by reference.

In some embodiments, the luminescent substance may be selected from materials that do not degrade when exposed to oxygen, moisture, sunlight, etc. and that may not require a protective overcoat. Such include various organic luminescent substances such as the perylene compounds disclosed above. For example, perylene compounds may be used as protective overcoats and thus do not require a protective overcoat.

Selected Specific Embodiments and Applications

In this invention, Plasma-shells of any gas encapsulating geometric shape are used as the pixel elements of a gas plasma display. A full color display is achieved using red, green and blue pixels. The following are some specific embodiments using an organic luminescent substance such as a luminescent phosphor.

Color Plasma Displays Using UV 300 nm to 380 nm Excitation with Organic Phosphors The organic luminescent substance such as an organic phosphor may be excited by UV ranging from about 300 nm to about 380 nm to produce red, blue, or green emission in the visible range. The encapsulated gas is chosen to excite in this range.

To improve life, the organic phosphor may be separated from the plasma discharge. This may be done by applying the organic phosphor to the exterior of the shell. In this case, the shell material is selected such that it is highly transmissive to UV in the range of about 300 nm to about 380 nm. Shell materials include aluminum oxides, silicon oxides, and other such materials. In the case where helium is used in the gas mixture, aluminum oxide is a desirable shell material as it does not allow the helium to permeate.

Color Plasma Displays Using UV Excitation Below 300 nm with Organic Phosphors Organic phosphors may be excited by UV below 300 nm. In this case, a xenon neon mixture of gases may produce excitation at 147 nm and 172 nm. The Plasma-shell shell material must be transmissive below 300 nm. Shell materials that are transmissive to frequencies below 300 nm include silicon oxide. The thickness of the shell material is minimized in order to maximize transmissivity.

Color Plasma Displays Using Visible Blue, Above 380 nm with Organic Phosphors Organic phosphors may be excited by excitation above 380 nm. The Plasma-shell material is composed completely or partially of an inorganic blue phosphor such as BAM. The shell material fluoresces blue and may be up-converted to red or green with organic phosphors on the outside of the shell

Infrared Plasma Displays

In some applications it may be desirable to have PDP displays with Plasma-shells that produce emission in the infrared range for use in night vision applications. This may be done with up-conversion phosphors as described above.

Application of Organic Phosphors

Organic phosphors may be added to a UV curable medium and applied to the gas encapsulating devices with a variety of methods including jetting, spraying, sheet transfer methods, or screen printing. This may be done before or after the gas encapsulating devices are added to a substrate or back plate.

Application of Phosphor Before Plasma-Shells are Added to Substrate

If organic phosphors are applied to the gas Plasma-shells before they are applied to the substrate, additional steps must be take to position the color sphere to the correct place on the back substrate.

Application of Phosphor after Plasma-Shells are Added to Substrate

If the organic phosphor is applied to the gas Plasma-shells after they are placed on a substrate, care must be take to align the appropriate color with appropriate sphere.

Application of Phosphor after Plasma-Shells are Added to Substrate-Self Aligning The gas filled Plasma-shells may be used to cure the phosphor. A single color organic phosphor is completely applied to the entire substrate containing the Plasma-shells. Next the Plasma-shells are selectively activated to produce UV to cure the organic phosphor. The phosphor will cure on the Plasma-shells that are activated and may be rinsed away from the Plasma-shells that were not activated. Additional applications of phosphor of different colors may be applied using this method to coat the remaining shells. In this way the process is completely self-aligning.

Tinted Plasma-Shells

In the practice of this invention the Plasma-shell may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber 690.

The use of tinted materials and/or gas discharges emitting light of different wavelengths may be used in combination with the above described phosphors and the light emitted from such phosphors. Optical filters may also be used.

High Resolution Color Display

Color Plasma-shells such as Plasma-discs may be stacked or arranged in parallel positions on the substrate. This configuration requires less area of the display surface compared to conventional displays that require red, green, and blue pixels next to each other on the substrate. This invention may be practiced with Plasma-shells that use various color gases such as the excimer gases. Phosphor coated Plasma-shells in combination with excimers may also be used. The Plasma-shells may comprise various combinations of Plasma-spheres, Plasma-discs, and/or Plasma-domes. A Plasma-sphere is a microsphere filled with gas. A Plasma-disc is a Plasma-sphere with multiple flattened sides including all six sides. A Plasma-dome is a Plasma-sphere with a flattened bottom and a domed top. The other four sides may be round or flat.

SUMMARY

Aspects of this invention may be practiced with a coplanar or opposing substrate PDP as disclosed in the U.S. Pat. Nos. 5,793,158 (Wedding) and 5,661,500 (Shinoda et al.) or with a single-substrate or monolithic PDP as disclosed in the U.S. Pat. Nos. 3,646,384 (Lay,) 3,860,846 (Mayer), 3,935,484 (Dick et al.) and other single substrate patents, discussed above and incorporated herein by reference.

In the practice of this invention, the Plasma-shells may be positioned and spaced in an AC gas discharge plasma display structure so as to utilize and take advantage of the positive column of the gas discharge. The positive column is described in U.S. Pat. No. 6,184,848 (Weber) and is incorporated herein by reference. In a positive column application, the Plasma-shells must be sufficient in length to accommodate the positive column discharge.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

The Plasma-shells may contain a gaseous mixture for a gas discharge display or may contain other substances such as an electroluminescent (EL) or liquid crystal materials for use with other displays technologies including electroluminescent displays (ELD), liquid crystal displays (LCD), field emission displays (FED), electrophoretic displays, and Organic EL or Organic LED (OLED).

The use of Plasma-shells on a flexible substrate allows the encapsulated pixel display device to be utilized in a number of applications. In one application, the device is used as a plasma shield or blanket to absorb electromagnetic radiation and to make the shielded object invisible to enemy radar. In this embodiment, a flexible sheet of Plasma-shells may be provided as a blanket over the shielded object.

In another embodiment, the PDP device is used to detect radiation such as nuclear radiation from a nuclear device, mechanism, apparatus or container. This is particularly suitable for detecting hidden nuclear devices at airports, loading docks, bridges, and other such locations As disclosed herein, this invention is not to be limited to the exact forms shown and described because changes and modifications may be made by one skilled in the art within the scope of the following claims.

The invention claimed is:

1. In a method for placing at least one Plasma-shell on a substrate having at least two electrodes to be electrically connected to each Plasma-shell, each Plasma-shell being located within a cavity on the substrate, the improvement wherein an electrically conductive bonding substance is applied to each Plasma-shell so as to form an electrical connection to each electrode.

2. The invention of claim 1 wherein each electrical connection on each Plasma-shell is separated from each other electrical connection on the Plasma-shell by a clearance space so as to prevent the conductive substance forming one electrical connection from flowing and electrically shorting out another electrical connection.

3. The invention of claim 1 wherein the Plasma-shell is a Plasma-sphere.

4. The invention of claim 1 wherein the Plasma-shell is a Plasma-disc.

5. The invention of claim 1 wherein the Plasma-shell is a Plasma-dome.

6. The invention of claim 1 wherein the cavity is a hole extending through the substrate.

7. In a method for placing at least one Plasma-shell on a substrate having at least two electrodes to be electrically connected to each Plasma-shell, the improvement wherein each said electrode is electrically connected to a Plasma-shell by a pad composed of an electrically conductive bonding substance, each connecting pad to each Plasma-shell being separated from each other pad to each Plasma-shell by a clearance space so as to prevent the flow of electrically conductive bonding substance from one pad to another.

8. The invention of claim 7 wherein the Plasma-shell is a Plasma-sphere.

9. The invention of claim 7 wherein the Plasma-shell is a Plasma-disc.

10. The invention of claim 7 wherein the Plasma-shell is a Plasma-dome.

11. The invention of claim 7 wherein each Plasma-shell is located within a cavity on the substrate.

12. In a display device comprising at least one Plasma-shell positioned on a substrate with at least two electrodes electrically connected to each Plasma-shell, the improvement wherein each said electrode is electrically connected to a Plasma-shell by an electrical connection composed of an electrically conductive bonding substance, each said electrical connection being separated from each other electrical connection to the Plasma-shell by a clearance space to prevent the flow and wicking of the electrically conductive bonding substance from one connection to another.

13. The invention of claim 12 wherein the Plasma-shell is a Plasma-sphere.

14. The invention of claim 12 wherein the Plasma-shell is a Plasma-disc.

15. The invention of claim 12 wherein the Plasma-shell is a Plasma-dome.

16. The invention of claim 12 wherein each Plasma-shell is located within a cavity on the substrate.

17. As an article of manufacture, a substrate having at least one Plasma-shell positioned on the substrate with at least two conductors electrically connected to each Plasma-shell, each conductor being electrically connected to a Plasma-shell by an electrical connection comprising an electrically conductive bonding substance, each said electrical connection being separated from each other electrical connection to the Plasma-shell by a clearance space to prevent the flow and wicking of the electrically conductive bonding substance from one connection to another.

18. The invention of claim 17 wherein the Plasma-shell is a Plasma-sphere.

19. The invention of claim 17 wherein the Plasma-shell is a Plasma-disc.

20. The invention of claim 17 wherein the Plasma-shell is a Plasma-dome.

21. The invention of claim 17 wherein each clearance space is an opening in the substrate.

22. The invention of claim 21 wherein the opening is a slot or channel.

23. The invention of claim 17 wherein the electrically conductive bonding substance is an organic substance with a conductive filler material.

24. The invention of claim 17 wherein the bonding substance is an epoxy resin with a filler material of noble metal.

25. The invention of claim 24 wherein the epoxy resin contains 60 to 80% by weight silver.

26. The invention of claim 17 wherein the electrically conductive bonding substance comprises a polymeric material.

* * * * *